US010109937B2

(12) United States Patent
Zerebilov et al.

(10) Patent No.: US 10,109,937 B2
(45) Date of Patent: Oct. 23, 2018

(54) ELECTRICAL CABLE CONNECTOR

(71) Applicant: FCI USA LLC, Etters, PA (US)

(72) Inventors: Arkady Zerebilov, Lancaster, PA (US); Michael Scholeno, York, PA (US); Hung Wei Lord, Harrisburg, PA (US); Joshua A. Garman, Mount Holly Springs, PA (US); Charles M. Gross, Etters, PA (US); Jason J. Ellison, New Cumberland, PA (US)

(73) Assignee: FCI USA LLC, Etters, PA (US)

( * ) Notice: Subject to any disclaimer, the term of this patent is extended or adjusted under 35 U.S.C. 154(b) by 23 days.

(21) Appl. No.: 15/031,359

(22) PCT Filed: Oct. 22, 2014

(86) PCT No.: PCT/US2014/061681
§ 371 (c)(1),
(2) Date: Apr. 22, 2016

(87) PCT Pub. No.: WO2015/061390
PCT Pub. Date: Apr. 30, 2015

(65) Prior Publication Data

US 2016/0268739 A1 Sep. 15, 2016

Related U.S. Application Data

(60) Provisional application No. 61/895,912, filed on Oct. 25, 2013.

(51) Int. Cl.
*H01R 12/59* (2011.01)
*H01R 9/24* (2006.01)
(Continued)

(52) U.S. Cl.
CPC ..... *H01R 12/596* (2013.01); *H01R 4/66* (2013.01); *H01R 9/034* (2013.01); *H01R 9/2483* (2013.01);
(Continued)

(58) Field of Classification Search
CPC ..... H01R 24/22; H01R 4/66; H01R 12/596; H01R 9/2483
See application file for complete search history.

(56) References Cited

U.S. PATENT DOCUMENTS 5,190,473 A 3/1993 Mroczkowski et al.
5,281,150 A 1/1994 Bundga et al.
(Continued)

FOREIGN PATENT DOCUMENTS

CN 1168547 A 12/1997
EP 0 997 756 A2 5/2000
EP 2 169 770 A2 3/2010

OTHER PUBLICATIONS

International Search Report and Written Opinion for International Application No. PCT/US2014/061681 dated Jan. 27, 2015.
(Continued)

*Primary Examiner* — James Harvey
(74) *Attorney, Agent, or Firm* — Wolf, Greenfield & Sacks, P.C.

(57) ABSTRACT

Embodiments of an electrical connector assembly are disclosed. The electrical connector assembly can include an electrical connector having a connector housing and a leadframe supported by the connector housing. The leadframe includes an electrically conductive ground plate that includes a drain wire connection tabs that can attach to drain wires of respective electrical cables. The electrical connector assembly can further include a cable clip that supports the plurality of cables. The electrical connector assembly can
(Continued)

further include a cable guide that directs the plurality of cables of cables through the cable clip along a desired direction.

17 Claims, 16 Drawing Sheets

(51) Int. Cl.

| | |
|---|---|
| ***H01R 24/22*** | (2011.01) |
| ***H01R 4/66*** | (2006.01) |
| ***H01R 9/03*** | (2006.01) |
| ***H01R 13/56*** | (2006.01) |
| ***H01R 24/60*** | (2011.01) |
| ***H01R 13/6471*** | (2011.01) |
| ***H01R 13/6592*** | (2011.01) |
| *H01R 13/6586* | (2011.01) |

(52) U.S. Cl.
CPC ..... *H01R 13/567* (2013.01); *H01R 13/6471* (2013.01); *H01R 13/6592* (2013.01); *H01R 24/22* (2013.01); *H01R 24/60* (2013.01); *H01R 13/6586* (2013.01)

(56) References Cited

U.S. PATENT DOCUMENTS 5,480,327 A * 1/1996 Zola ..... H01R 9/0518 439/445
5,961,348 A 10/1999 Murphy
7,025,634 B1 4/2006 Swantner et al.
7,510,439 B2 3/2009 Gordon et al.
8,253,021 B2 * 8/2012 Adachi ..... H02G 3/26 174/135
8,772,636 B2 * 7/2014 Yamaguchi ..... B60R 16/0215 174/68.1
2001/0031579 A1 10/2001 Fujino et al.
2002/0136519 A1 * 9/2002 Tinucci ..... G02B 6/4471 385/134
2004/0127078 A1 * 7/2004 Tondreault ..... H01R 4/242 439/98
2007/0287332 A1 12/2007 Gordon et al.
2009/0188716 A1 7/2009 Nagase
2013/0130547 A1 5/2013 Simpson et al.
2013/0149899 A1 6/2013 Schroll et al.
2016/0268739 A1 * 9/2016 Zerebilov ..... H01R 24/60

OTHER PUBLICATIONS

International Preliminary Report on Patentability for International Application No. PCT/US2014/061681 dated May 6, 2016.
Extended European Search Report for European Application No. 14855318.3 dated Apr. 21, 2017.

* cited by examiner

ELECTRICAL CABLE CONNECTOR

CROSS-REFERENCE TO RELATED APPLICATIONS

This application is the National Stage Application of International Application No. PCT/US2014/061681, filed Oct. 22, 2014, which claims the benefit of U.S. Patent Application Ser. No. 61/895,912 filed on Oct. 25, 2013, the disclosure of each of which are hereby incorporated by reference as if set forth in its entirety herein.

BACKGROUND

Electrical connectors include dielectric or electrically insulative connector housings, and a plurality of electrical contacts supported by the housing. The electrical contacts define mating ends that are configured to mate with a complementary electrical connector. The mounting ends are configured to be mounted to a complementary electrical component. In some applications, the mounting ends are configured to be placed in communication with conductive cables that include electrical signal conductors and drain wires.

SUMMARY

In accordance with one embodiment, an electrical connector includes an electrically insulative connector housing, and a leadframe supported by the connector housing. The leadframe includes an electrically insulative leadframe housing and a plurality of electrical signal contacts supported by the leadframe housing. The electrical connector can further include an electrically conductive ground plate positioned adjacent to the leadframe housing, the ground plate including an electrically conductive plate body and a drain wire connection tab that projects out from the plate body. The electrical connector can be configured to receive at least one electrical cable such that signal conductors of the electrical cable are attached to the signal contacts and a drain wire of the electrical cable is mechanically attached to the drain wire connection tab, thereby placing the drain wire in electrical communication with the ground plate.

BRIEF DESCRIPTION OF THE DRAWINGS

The foregoing summary, as well as the following detailed description of example embodiments of the application, will be better understood when read in conjunction with the appended drawings, in which there is shown in the drawings example embodiments for the purposes of illustration. It should be understood, however, that the application is not limited to the precise arrangements and instrumentalities shown. In the drawings.

DETAILED DESCRIPTION

Figure 1:
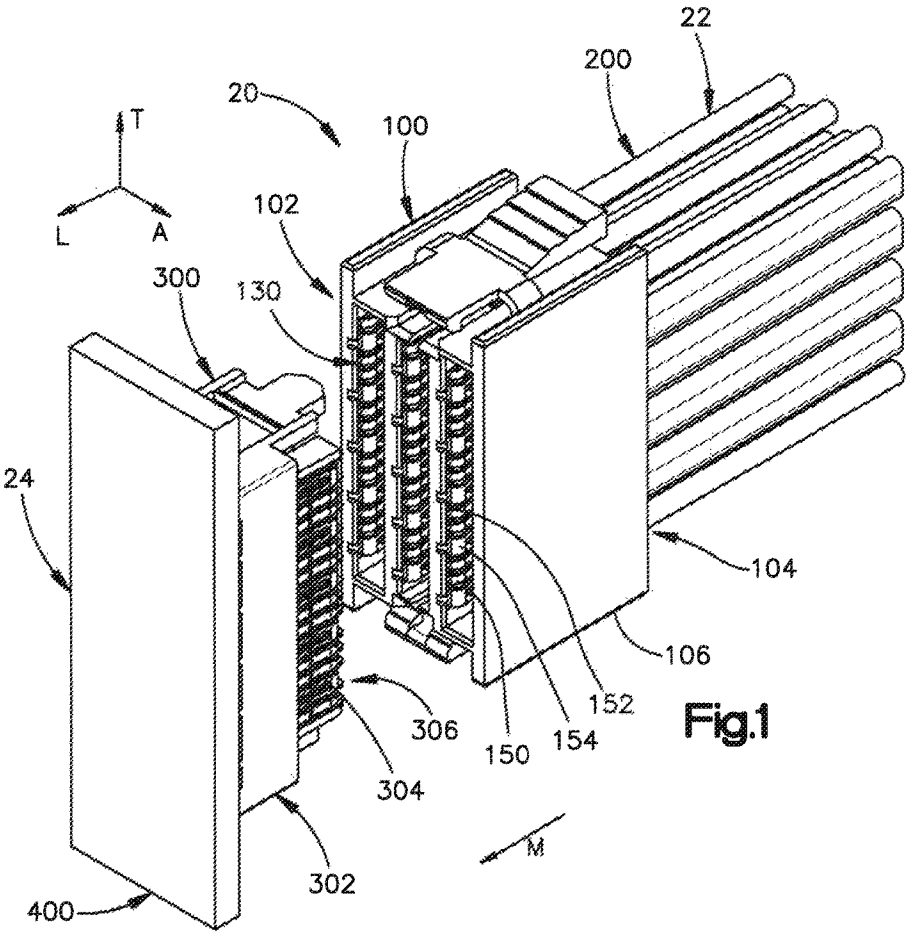
FIG. 1 is an exploded perspective view of an electrical connector system constructed in accordance with one embodiment, including a first electrical connector and a second electrical connector.

For convenience, the same or equivalent elements in the various embodiments illustrated in the drawings have been identified with the same reference numerals. Referring initially to FIG. 1, an electrical connector system 20 constructed in accordance with one embodiment can include a first electrical connector assembly 22 and a second or complementary electrical connector assembly 24. The first electrical connector assembly 22 is configured to be mated with the second or complementary electrical connector assembly 24 in a mating direction M that is along a longitudinal direction L. The first electrical connector assembly 22 can include a first electrical connector 100 and at least one first electrical component such as at least one electrical cable 200, including a plurality of electrical cables 200. The complementary electrical assembly 24 can include a complementary or second electrical connector 300 and a second electrical component such as a substrate 400 that can be configured as a printed circuit board.

The first and second electrical connectors 100 and 300 can be configured to be mated with each other so as to establish an electrical connection between the first and second electrical connectors 100 and 300, and thus between the first and complementary electrical connector assemblies 22 and 24, respectively. The first electrical connector 100 can be configured to be mounted to the plurality of electrical cables 200 so as to place the first electrical connector 100 in electrical communication with the plurality of electrical cables 200. Similarly, the second electrical connector 300 can be configured to be mounted to the substrate 400 so as to establish an electrical connection between second electrical connector 300 and the substrate 400. Thus, the electrical cables 200 can be placed in electrical communication with the substrate 400 when the first and second electrical connectors 100 and 300 are mounted to the electrical cables 200 and the substrate 400, respectively, and mated to each other.

Figure 2:
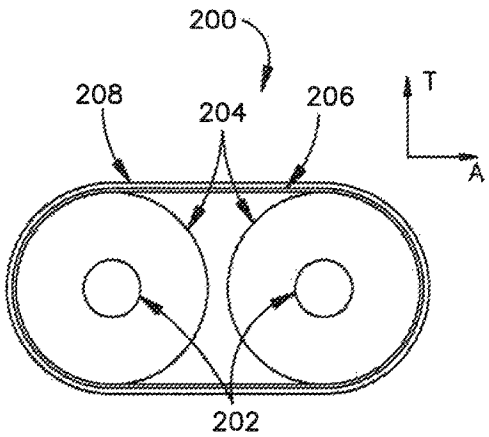
FIG. 2 is an end elevation view of an electrical cable configured to be placed in electrical communication with the first electrical connector.

The substrate 400 can be provided as a backplane, midplane, daughtercard, or the like. The electrical cables 200 can include as signal conductors and at least one drain, power cables, optical cables, or any suitable alternatively constructed conductive cables. As illustrated in FIG. 2, each of the electrical cables 200 include at least one signal carrying conductor 202, such as a pair of signal carrying conductors 202, and an electrically insulative layer 204 that surrounds each of the pair of signal carrying conductors 202. The electrically insulative layers 204 of each cable can reduce the crosstalk imparted by one of the conductors 202 of the cable 200 to the other of the conductors 202 of the cable 200. Each of the cables 200 can further include an electrically conductive ground jacket 206 that surrounds both of the respective insulative layer 204 of the cable 200. The ground jacket 206 can be connected to a respective ground plane of a complementary electrical component to which the cable 200 is mounted. For example, in accordance with the illustrated embodiment, the ground jacket 206 of each of the plurality of cables 200 can be placed into electrical communication with an electrically conductive ground plate 168 of the first electrical connector 100, as described in more detail below. For instance, in accordance with certain embodiments, the ground jacket 206 can carry a drain wire 207 (see FIG. 3) that, in turn, is connected to a ground contact 154 of the first electrical connector 100. Each of the cables 200 can further include an outer layer 208 that is electrically insulative and surrounds the respective ground jacket 206. Thus, each of the electrical cables 200 defines an outer electrically insulative layer that surrounds at least one or more up to all of the signal conductors 202, the ground jacket 206, and the drain wire 207. Respective exposed ends 214 of the conductors 202 can be exposed and configured to attach to respective mounting ends of signal contacts, and a portion of the drain wires 207 can be exposed and configured to attach to respective mounting ends of ground contacts. The exposed portions of the drain wires 207 can be recessed with respect to the exposed ends 214 of the conductors 202. The outer layer 208 can reduce the crosstalk imparted by the respective cable 200 to another one of the plurality of cables 200. The insulative layer 204 and the outer layer 208 can be constructed of any suitable dielectric material, such as plastic. The conductors 202 can be constructed of any suitable electrically conductive material, such as copper.

With continuing reference to FIG. 1, the first electrical connector assembly 22 can be referred to as an electrical cable assembly, including the first electrical connector 100 that can be referred to as a cable connector configured to be mounted to the plurality of electrical cables 200 so as to place the first electrical connector 100 in electrical communication with each of the plurality of electrical cables 200. The first electrical connector 100 can include a dielectric or electrically insulative connector housing 106 and a plurality of electrical contacts 150 that are supported by the connector housing 106. The plurality of electrical contacts 150 can include a plurality of signal contacts 152 and a plurality of ground contacts 154.

Figure 3:
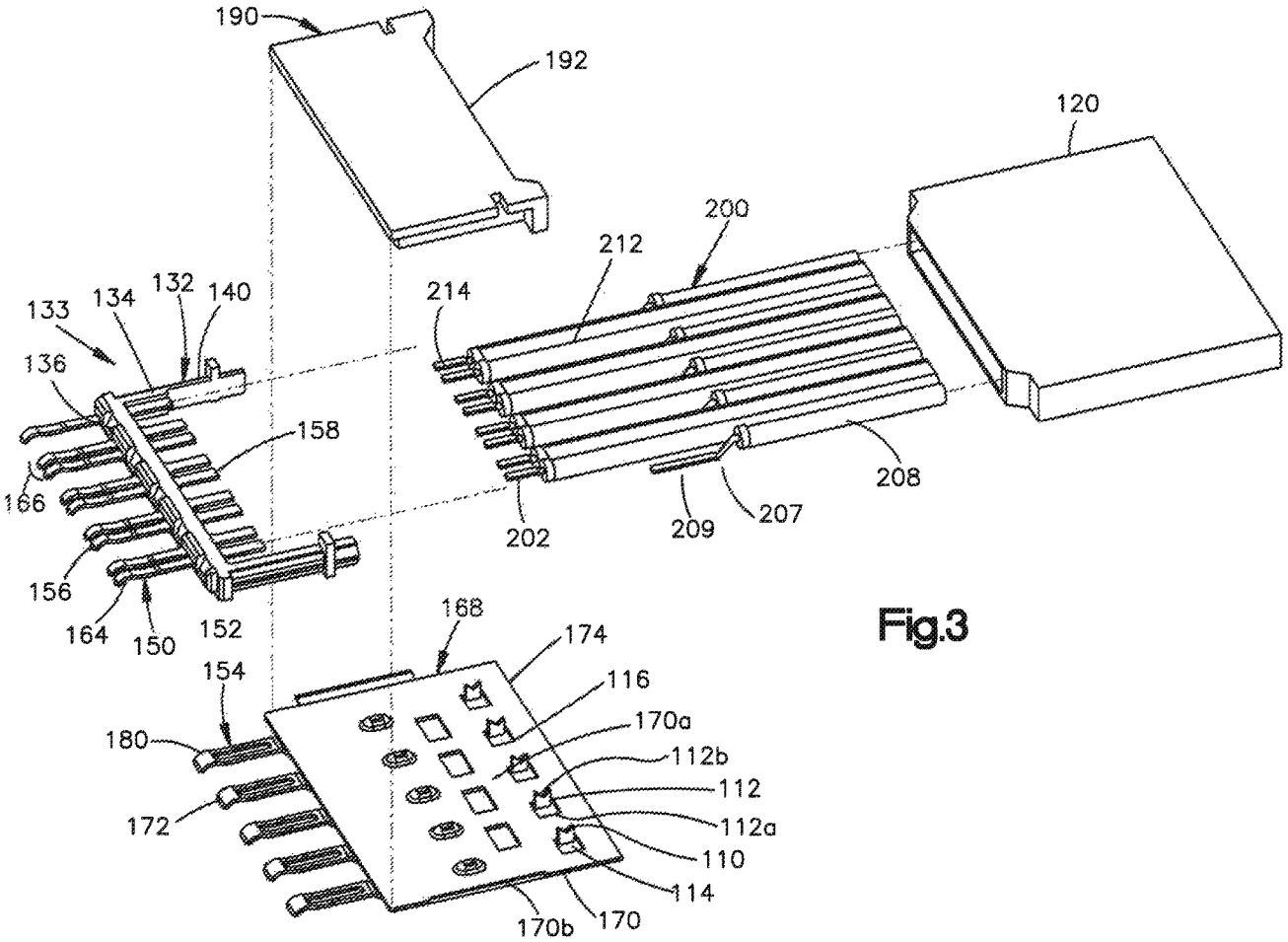
FIG. 3 is an exploded perspective view of a leadframe assembly and a plurality of electrical cables illustrated in FIG. 2 configured to be placed in electrical communication with the leadframe assembly.

Referring also to FIG. 3, in accordance with one embodiment, the first electrical connector 100 can include a plurality of leadframe assemblies 130 that are supported by the connector housing 106. Each of the leadframe assemblies 130 can include a dielectric or electrically insulative leadframe housing 132 and respective ones of the plurality of the electrical contacts 150 supported by the leadframe housing 132. Thus, it can be said that the electrical contacts 150 are supported by both the respective leadframe housing 132 and the connector housing 106. For instance, a plurality of signal contacts 152 can be supported by the leadframe housing 132 so as to define a leadframe 133.

In accordance with the illustrated embodiment, the first electrical connector 100 is constructed as a vertical electrical connector. In particular, the connector housing 106 defines a mating interface 102 that is configured to engage a complementary mating interface of the second electrical connector 300 when the first and second electrical connectors 100 and 300 mate with each other. The connector housing 106 further defines a mounting interface 104 that is configured to engage the electrical cables 200 when the first electrical connector 100 is mounted to the electrical cables 200. The mating interface 102 can be oriented parallel to the mounting interface 104. Further, the electrical contacts 150 include electrical signal contacts 152 and ground contacts 154. The electrical signal contacts 152 define respective mating ends 156 that are configured to mate with complementary mating ends of electrical contacts of the second electrical connector 300, and respective mounting ends 158 that are configured to be placed in electrical communication with, for instance mounted to, respective ones of the conductors 202 of the electrical cables 200. The mating ends 156 are oriented parallel to the mounting ends 158, such that the electrical signal contacts 152 can be referred to as vertical contacts. Alternatively, the first electrical connector 100 can be configured as a right-angle electrical connector whereby the mating interface 102 and the mounting interface 104 are oriented perpendicular with respect to each other, and the mating ends 156 and the mounting ends 258 are oriented perpendicular to each other.

Each of the ground contacts 154 can define respective ground mating ends 172 that extend along or parallel to the mating interface 102, and ground mounting ends 174 that extend along or parallel to the mounting interface 104 and can be in electrical communication with the ground mating ends 172. Thus, it can be said that the electrical contacts 150 can define mating ends, which can include the mating ends 156 of the electrical signal contacts 152 and the ground mating ends 172, and the electrical contacts 150 can further define mounting ends, which can include the mounting ends 158 of the electrical signal contacts 152 and the ground mounting ends 174. Each ground contact 154, including the ground mating ends 172 and the ground mounting ends 174, can be defined by a ground plate 168 of the respective leadframe assembly 130. The ground plate 168 can be positioned adjacent to the leadframe housing 132. For instance, the ground plate 168 can be supported by the leadframe housing 132. The ground plate 168 can be electrically conductive as desired, and can reduce crosstalk between the electrical signal contacts 152 of adjacent leadframe assemblies 130. Thus, the ground plate 168 can be said to define a crosstalk shield. Alternatively, the ground mating ends 172 and ground mounting ends 174 can be defined by individual ground contacts as desired. Thus, reference herein to one or more components of a ground contact can refer to components of one of the ground plates 168, or can refer to components of individual ground contacts. Furthermore, reference to a ground contact can refer to a ground plate 168 or an individual ground contact having a single ground mating end 172 and a single ground mounting end 174. It should be further appreciated that the mating ends 156 and the ground mating ends 172 can be configured as receptacle contacts. The first electrical connector 100 can constructed in accordance with any suitable embodiment as desired. For instance, the first electrical connector 100 can be configured as described in U.S. patent application Ser. No. 13/836,610 filed Mar. 15, 2013, the disclosure of which is hereby incorporated by reference as if set forth in its entirety herein.

Figure 4A:
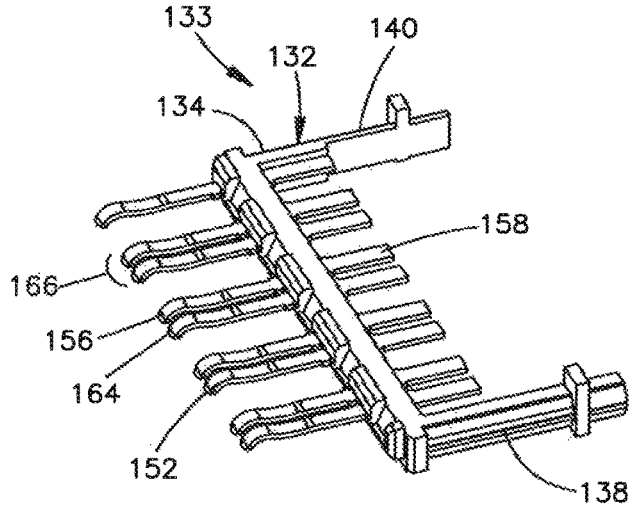
FIG. 4A is a perspective view of a portion of a leadframe assembly including a plurality of electrical signal contacts supported by a leadframe housing in accordance with on embodiment.
Figure 4B:
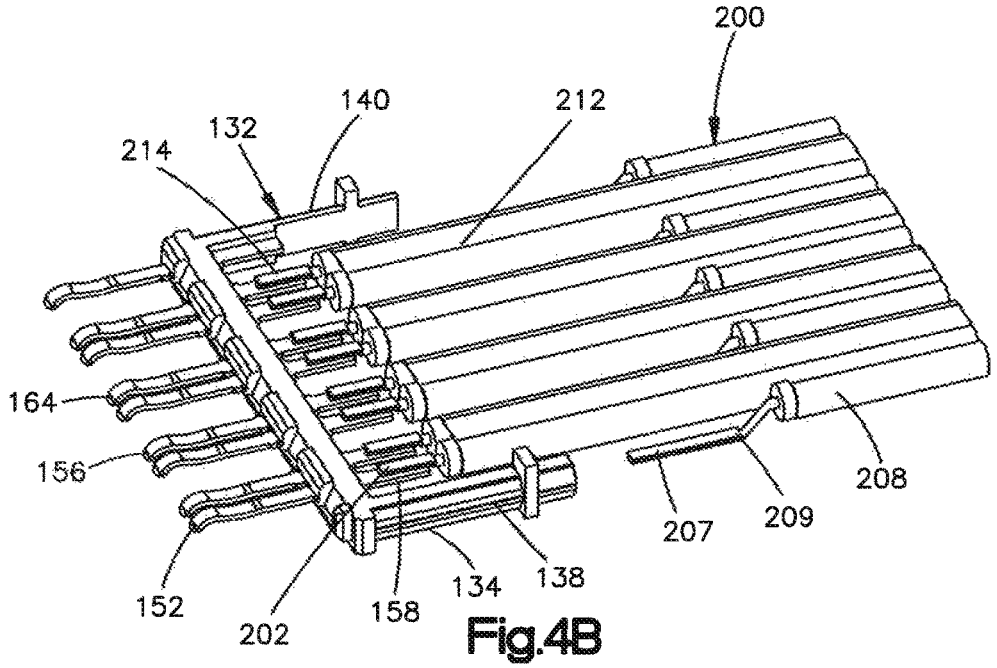
FIG. 4B is a perspective view of a portion of the leadframe assembly illustrated in FIG. 4A, but further including a plurality of electrical cables having electrical signal conductors mounted to respective ones of the signal contacts.

As illustrated in FIGS. 3 and 4A-4B, the leadframe housing 132 can be overmolded onto the respective ones of the electrical contacts 150, such as the signal contacts 152 so as to define an insert molded leadframe assembly (IMLA). Alternatively, respective ones of the electrical contacts 150, such as the signal contacts 152, can be stitched into the leadframe housing 132 or otherwise supported by the leadframe housing 132 as desired. Respective ones of the plurality of electrical contacts 150 of each of the leadframe assemblies 130 can be arranged along a column direction, which extends along a transverse direction T that is perpendicular to the longitudinal direction L. Adjacent ones of the leadframe assemblies 130 can be spaced along a row direction that is perpendicular to the column direction. For instance, the row direction can extend along a lateral direction A that is perpendicular to both the longitudinal direction L and the transverse direction T.

Figure 4C:
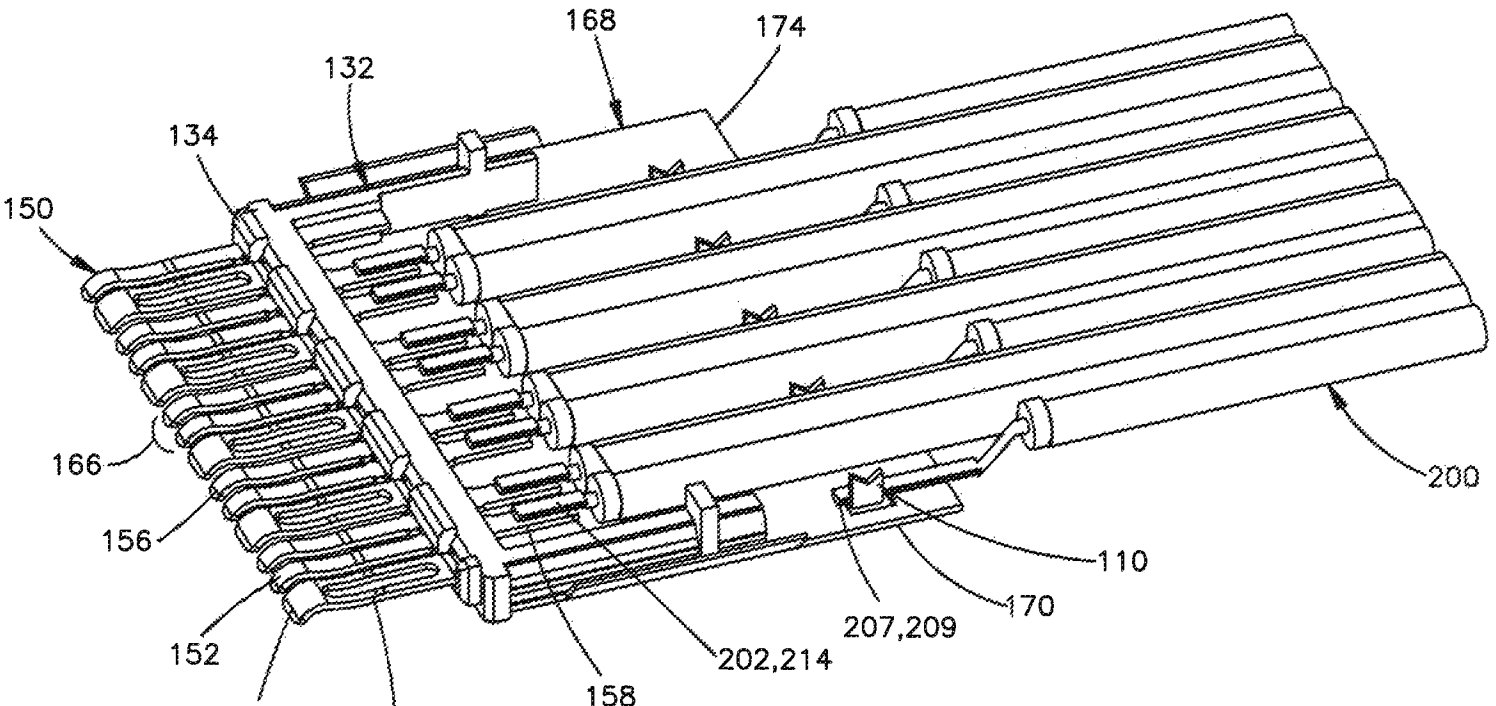
FIG. 4C is a perspective view of a portion of the leadframe assembly illustrated in FIG. 4B, but including a ground plate.

The electrical signal contacts 152 and ground contacts 154 can be arranged in any manner as desired. For instance, adjacent signal contacts 152 can define differential signal pairs 166 or single ended signal contacts as desired. One or more of the ground contacts 154 can be disposed between adjacent pairs of differential signal pairs 166. For instance, when ground plate 168 is supported by the leadframe housing 132, the signal contacts 152 and the ground contacts 154 can be said to be supported by the leadframe housing 132. When the electrical contacts 150 are supported by respective leadframe housings 132, adjacent signal contacts 152, for instance along the column direction, can define differential signal pairs 166. The leadframe assemblies 130 can include ground contacts 154 disposed between adjacent pairs of differential signal pairs 166 along the column direction. When the first electrical connector 100 is mounted to the electrical cables 200, the signal contacts 152 are placed in electrical communication with the conductors 202 as illustrated in FIG. 4B, and the ground contacts 154 are placed in electrical communication with the drain wire 207, as illustrated in FIG. 4C. Thus, the ground contacts 154 can further be placed in electrical communication with the ground jacket 206.

Referring again to FIGS. 3 and 4A-4B, each leadframe assembly 130 includes a plurality of signal contacts 152 that are supported by the leadframe housing 132 and a ground contact 154 configured as the electrically conductive ground plate 168. The signal contacts 152 can be overmolded by the dielectric leadframe housing 132 such that the leadframe assemblies 130 are configured as insert molded leadframe assemblies (IMLAs), or the signal contacts 152 can be stitched into or otherwise supported by the leadframe housing 132. The ground plate 168 can be attached to the dielectric leadframe housing 132 (see FIG. 4C). The signal contacts 152, including the mating ends 156 and the mounting ends 158, of each leadframe assembly 130 are spaced from each other along the column direction. The leadframe assemblies 130 can be spaced along the lateral direction A in the connector housing 106.

The leadframe housing 132 includes a housing body 134 that defines a front wall 136 that defines extends along the lateral direction A and defines opposed first and second ends that are spaced apart from each other along the lateral direction A. The front wall 136 can be configured to at least partially support the respective signal contacts 152 of the leadframe assembly 130. For example, in accordance with the illustrated embodiment, the signal contacts 152 are supported by the front wall 136 such that the signal contacts 152 are disposed between the first and second ends of the front wall 136. Furthermore, the front wall 136 is disposed between the mating ends 156 and the mounting ends 158. The leadframe 133 can be configured such that the plurality of mating ends 156 extend from the leadframe housing 132 along the longitudinal direction L, and in the mating direction M.

The leadframe housing 132 can further define first and second attachment arm 138 and 140, respectively, that extend rearward from the front wall 136 along the longitudinal direction L. The first and second attachment arm 138 and 140 can operate as attachment locations for at least one or both of the ground plate 168 and an electrically conductive termination housing 190. The leadframe housing 132 can alternatively or additionally include any suitable attachment locations as desired. The termination housing 190 can be a metal, and die cast, in accordance with one embodiment, or made from any suitable alternative material, for instance a lossy material that can be electrically conductive or nonconductive as desired, and made from any suitable method as desired. The first attachment arm 138 can be disposed closer to the first end of the front wall 136 than to the second end, for example substantially at the first end. Similarly, the second attachment arm 140 can be disposed closer to the second end of the front wall 136 than to the first end, for example substantially at the second end.

Each cable 200 can define an end 212 that can be configured such that respective portions of each of the signal carrying conductors 202 are exposed, the exposed portion of each signal carrying conductor 202 defining a respective exposed signal conductor end 214. Respective portions of the insulative and outer layers 204 and 208, respectively, and the ground jacket 206 of each cable 200 (see FIG. 2) can be removed from the respective signal carrying conductors 202 at the end 212 so as to expose the signal conductors ends 214. The respective portions of the insulative and outer layers 204 and 208, respectively, and the ground jacket 206 of each cable 200 can be removed such that each signal conductor end 214 extends outward from the insulative and outer layers 204 and 208, respectively, and the ground jacket 206 along the longitudinal direction L. Alternatively, the plurality of cables 200 can be manufactured such that the respective signal carrying conductors 202 extend longitudinally outward from the insulative and outer layers 204 and 208, respectively, and the ground jacket 206 at the end 212 of each cable 200, so as to expose the conductor ends 214. Additionally, a portion of the outer layer 208 rearward of the conductor end 216 of each cable 200 can be removed, thereby defining a respective exposed portion 209 of the drain wire 207 of each cable 200. Alternatively, the plurality of cables 200 can be manufactured with at least a portion of the outer layer 208 removed so as to define the exposed portions 209 of the drain wires 207.

As illustrated in FIG. 4B, the electrical connector 100 is configured to receive at least one electrical cable 200 such that signal conductors 202 of the electrical cable 200 are attached to one of the signal contacts 152, for instance to the mounting end 158. The drain wire 207 of the electrical cable 200 is mechanically attached to the ground plate 168 as illustrated in FIG. 4C. For instance, each of the electrical cables 200 can have an end 212 that defines an exposed end 214 of the conductors 202 that is configured to be mounted or otherwise attached to the signal contacts 152, and thus to the leadframe 133. The drain wires 207 can have an exposed portion 209 that is configured to be mounted or otherwise attached to the ground contact 154, and in particular the ground plate 168, so as to place the ground jacket 206 in electrical communication with the ground plate 168.

Referring again to FIGS. 1-4B, the signal contacts 152 define respective mating ends 156 that are arranged along, and are thus parallel with, the mating interface 102, and mounting ends 158 that are arranged along, and are thus parallel with, the mounting interface 104. The mating end 156 of each signal contact 152 can be constructed as a receptacle mating end that defines a curved tip 164. The signal contacts 152 can be arranged in pairs 166, which can define edge-coupled differential signal pairs. Any suitable dielectric material, such as air or plastic, may be used to isolate the signal contacts 152 from one another. The mounting ends 158 can be provided as cable conductor mounting ends, each mounting end 158 configured to be placed in electrical communication with a signal conductor end 214 of a respective one of the plurality of cables 200.

Referring now to FIGS. 3 and 4C in particular, the ground plate 168 includes the electrically conductive plate body 170. The plate body 170 can be a metallic plate body. The plate body 170 can be substantially planar as illustrated, or can define any suitable shape and size as desired. The ground plate 168 can be configured such that the plurality of ground mating ends 172 extend from the plate body 170, for instance forward from the plate body 170 along the longitudinal direction L, and in the mating direction M. The ground mating ends 172 can be monolithic with the plate body 170 as illustrated. The ground mounting ends 174 can be defined by the ground plate body 170, and thus can be continuous with each other along the transverse direction T. As described above, the ground plate 168 can be said to define a crosstalk shield, such that the plate body 170 can define a metallic shield body. The ground mating ends 172 are aligned along the transverse direction T. Each ground mating end 172 can be constructed as a receptacle ground mating end that defines a curved tip 180. The plate body 170 defines a first plate body surface that can define and inner surface 170*a* and an opposed second plate body surface that can define a second or outer surface 170*b* of the body of the ground plate 168. The outer surface 170*b* is spaced from the inner surface 170*a*, along the lateral direction A. The inner surface 170*a* faces the plurality of cables 200 when the ground plate 168 is attached to the leadframe housing 132. The ground plate 168 can further include opposed first and second side walls that are spaced apart from each other along the transverse direction T such that the leadframe housing 132 can be received between the first and second side walls in an interference fit, for example by pressing the leadframe housing 132 toward the ground plate 168 such that the leadframe housing 132 snaps into place between the first and second side walls. Each of the first and second side walls can include a wing that extends outwardly from the ground plate body 170 along the transverse direction T, the wings configured to be supported by the connector housing 106 when the leadframe assembly 130 is inserted into and mounted to the connector housing 106. The ground plate 168 can be formed from any suitable electrically conductive material. For instance, the ground plate 168 can be formed from a metal.

Because the mating ends 156 of the signal contacts 152 and the ground mating ends 172 of the ground plate 168 are provided as receptacle mating ends and receptacle ground mating ends, respectively, the first electrical connector 100 can be referred to as a receptacle connector as illustrated. In accordance with the illustrated embodiment, each ground plate 168 can define a plurality of signal pairs 166, which can define differential signal pairs, and an extra single signal contact 142 reserved. For instance, the ground plate 168 can define five ground mating ends 172 and nine signal contacts 152. The nine signal contacts 152 can include four pairs 166 of signal contacts 152 configured as edge-coupled differential signal pairs, with the ninth signal contact 152 reserved. The ground mating ends 172 and the mating ends 156 of the signal contacts 152 of each leadframe assembly 130 can be arranged in a column that extends along the column direction. Thus, the ground mating ends 172 are aligned with the mating ends 156 of the signal contacts 152 when the ground plate 168 is positioned adjacent to the leadframe housing 132. In accordance with one embodiment, the ground mating ends 172 are aligned with the mating ends 156 of the signal contacts 152 when the ground plate 168 is supported by the leadframe housing 132. The differential signal pairs 166 can be disposed between successive ground mating ends 172, and the extra ninth signal contact 152 can be disposed adjacent one of the ground mating ends 172 at the end of the column.

Each of the plurality of leadframe assemblies 130 can include a plurality of first leadframe assemblies 130 provided in accordance with a first configuration and a plurality of second leadframe assemblies 130 provided in accordance with a second configuration. The termination housing 190 or other component of the leadframe assembly 130 can include a first indicator, such as an "A" to identify one of the first plurality of leadframe assemblies 130, and a second indicator such as a "B" to identify one of the second plurality of leadframe assemblies 130. In accordance with the first configuration, the extra signal contact 152 of the first leadframe assembly 130 is disposed at an upper end of the column of electrical contacts 150. In accordance with the second configuration, the extra signal contact 152 of the second leadframe assembly 130 is disposed at a lower end of the column of electrical contacts 150. It should be appreciated that the respective leadframe housings 132 of the first and second leadframe assemblies 130 can be constructed substantially similarly but with structural differences accounting for the respective configurations of electrical contacts 150 within the first and second leadframe assemblies 130 and for the configurations of the respective ground plates 168. It should further be appreciated the illustrated ground plate 168 is configured for use with the first leadframe assembly 130, and that the ground plate 168 configured for use with the second leadframe assembly 130 may define the ground mating ends 172 at locations along the plate body 170 that are different from those of the ground plate 168 configured for use with the first leadframe assembly 130.

With continuing reference to FIGS. 3 and 4C, the ground plate 168 includes the metallic plate body 170 and a plurality of drain wire connection tabs 110 that project out from the plate body 170, for instance at the ground mounting end 174. The drain wire connection tabs 110 are configured to attach to respective ones of the exposed portions of the drain wires 207, such that the plate body 170 places the attached drain wires 207 in electrical communication with each other. The first electrical connector 100 is configured to receive the electrical cables 200 such that signal conductors 202 of the electrical cable are attached to the signal contacts 152 and the drain wires 207 are mechanically attached to respective ones of the drain wire connection tab 110. The drain wire connection tab 110 includes a tab body 112 having a proximal end 112*a* that is attached to the plate body 170 and a free distal end 112*b* opposite the proximal end 112*a*, the free distal end 112*b* spaced from the proximal end 112*a*, for instance along the lateral direction A. The drain wire connection tabs 110 can be configured as a crimp member that is movable with respect to the plate body 170 such that the free distal end 112*b* moves toward the plate body 170, thereby capturing the exposed portion 209 of the drain wire 207 in electrical communication with the ground plate 168. For instance, the tab body 112 can be placed adjacent the tab body 112, and the tab body 112 can be bent toward the plate body 170 so as to capture the exposed portion 209 of the drain wire between the tab body 112 and the plate body 170. Alternatively, the tab body 112 can be crimped about the drain wire 207. Alternatively still, the exposed portions 209 of the drain wires 207 can be attached, for instance soldered or welded, to the drain wire connection tab 110 so as to place the drain wires 207 in electrical connection with the ground plate 168 and each other.

The drain wire connection tab 110 can be cut out from the plate body 170 so as to define an aperture 116 that extends through the plate body 170. The drain wire connection tab 110 can then be bent so as to project out from the plate body 170 such that the drain wire connection tab 110 defines the proximal end 112*a* and the free distal end 112*b*. The drain wire connection tab 110 can be attached to the plate body 170 at an interface 114. The interface 114 can be elongate along the mating direction M, and thus substantially parallel to the ground mating ends 172.

Figure 4D:
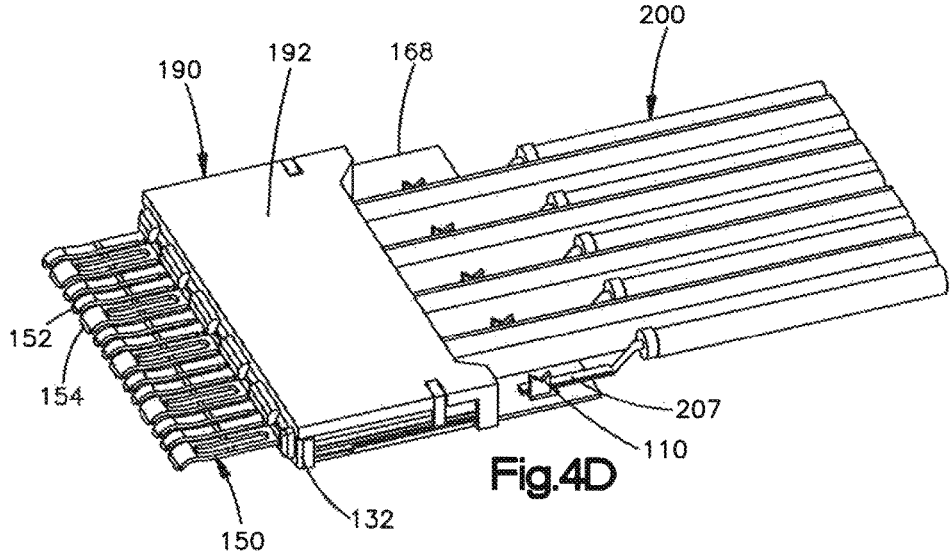
FIG. 4D is a perspective view of a portion of the leadframe assembly illustrated in FIG. 4C, but including a termination housing.

Referring now also to FIG. 4D, the leadframe assembly 130, and thus the electrical connector 100, can further include the termination housing 190 that is configured to secure to the leadframe housing 132 so as to capture the exposed portions of the outer insulative layer of the electrical cables 200 between the ground plate 168 and the termination housing 190. The termination housing 190 can further be configured to isolate each of the electrical cables 200 from the others of the electrical cables 200. The termination housing 190 can be electrically conductive, and includes an electrically conductive body 192 that can be configured to attach to the ground plate 168. In accordance with one embodiment, the electrically conductive body 192 is metallic. The termination housing 190 can cover at least a portion of a first side of the leadframe assembly 130 such that the signal contacts 152 are disposed between the ground plate 168 and the termination housing 190. The termination housing 190 can further include a second portion that covers at least a portion of a second side of the leadframe assembly 130 that is opposite the first side. The first and second portions of the termination housing 190 can be attached to each other so as to capture the ground plate 168 between the first and second portions. For instance, the first and second portions of the termination housing 190 can be welded, soldered, clipped, or otherwise attached to each other. The signal conductors 202 attach to the mounting ends 158 at a location, and the termination housing 190 can cover and substantially encapsulate the location. For instance, the exposed portions of the signal conductors 202 can be soldered, welded, or otherwise attached to respective ones of the mounting ends 158 in any manner as desired. In accordance with one embodiment, the termination housing 190 can secure the ground plate 168 to the leadframe housing 132.

Figure 4E:
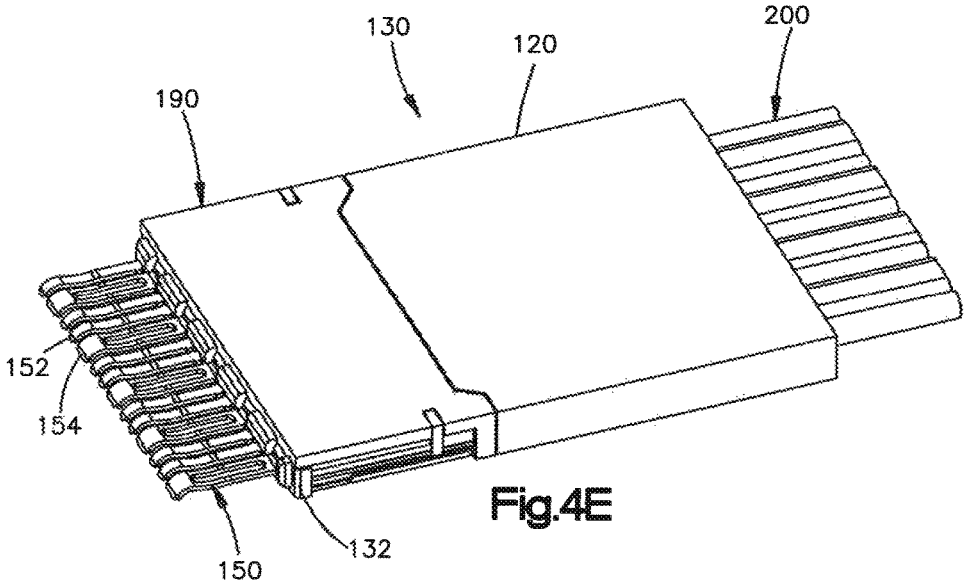
FIG. 4E is a perspective view of the leadframe assembly illustrated in FIG. 4D, further including a strain relief housing.

With continuing reference to FIGS. 3 and 4E, the leadframe assembly 130, and thus the electrical connector 100, further includes a dielectric or electrically insulative strain relief housing 120 that encapsulates at least a connection location between the drain wire 207 and drain wire connection tab 110. For instance, the strain relief housing 120 can encapsulate the exposed portion of the drain wire and an entirety of the ground plate 168 that extends out from the termination housing 190. Thus, the strain relief housing 120 further encapsulates the drain wire connection tabs 110. Further, the strain relief housing 120 can surround at least a length of the outer electrically insulative layer of the electrical cables 200. In accordance with one embodiment, the strain relief housing 120 is overmolded onto the cables 200, the exposed portions 209 of the drain wires 207, the drain wire connection tabs 110, and the ground mounting end 174. Accordingly, a tensile load applied to the electrical cables 200, and in particular to the outer insulative layer, at a location outside the strain relief housing 120 will be absorbed by the strain relief housing 120, and will not be transferred to the attachment locations of either the drain wires 107 and the ground plate 168, or the signal conductors 202 and the signal contacts 152.

Figure 5A:
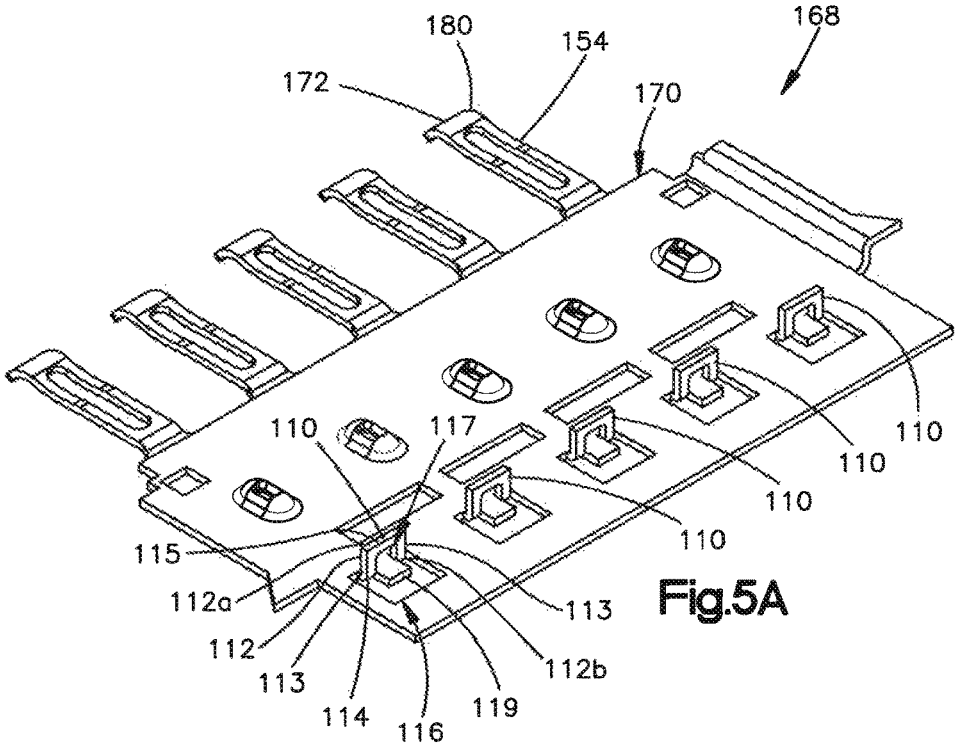
FIG. 5A is a perspective view of a ground plate constructed in accordance with an alternative embodiment.

Referring now to FIG. 5A, it should be appreciated that the drain wire connection tabs 110 can be constructed in accordance with any alternative embodiment suitable to facilitate attachment of the drain wires 207 to the ground plate 168. For instance, the tab body 112 can include a pair of uprights 113 that extend out from the plate body 170, and a crossbar 115 that extends between the uprights 113, from one of the uprights to the other of the uprights at a location spaced from the plate body 170. Thus, the crossbar 115 can define the free distal end 112*b*. The crossbar 115 can extend substantially parallel to the plate body 170, or in any other direction as desired. Thus, the interface 114 can be elongate between the uprights 113, and thus along a direction that is angularly offset with respect to the mating direction M. For instance, the interface 114 can be elongate along a direction that is perpendicular to the mating direction M. Further, the drain wire connection tab 110 illustrated in FIG. 5A defines an opening 117 that extends through the tab body 112. For instance, the opening 117 can be defined between the uprights 113, and further between the crossbar 115 and the plate body 170. The opening 117 can be sized to receive the exposed portion 209 of the drain wire 207, such that the tab body 112 can be bent toward the plate body 170 so as to capture the exposed portion 209 of the drain wire between the tab body 112 and the plate body 170. Alternatively, the tab body 112 can be crimped about the drain wire 207. Alternatively still, the drain wire 207 can extend through the opening 117 and can contact the drain wire connection tab 110 without bending the tab 110 with respect to the plate body 170. For instance, the drain wire 207 can be bent as it extends through the opening so as to maintain contact with the drain wire connection tab 110. Thus, the strain relief housing 120 can be overmolded onto both the drain wire connection tabs 110 and the exposed portions 209 of the drain wires 207, thereby securing the drain wires 207 in contact with the respective drain wire connection tabs 110 either with or without first crimping the drain wire connection tabs 110 about the drain wires 207, or first bending the drain wire connection tabs 110 so as to capture the drain wires 207 between the drain wire connection tabs 110 and the plate body 170.

Because the drain wire connection tab 110 can be cut, for instance punched or stamped, from the plate body 170, the ground plate 168 can define an aperture 116 that extends through the plate body 170. The aperture 116 can be sized and shaped substantially equal to the size and shape of the drain wire connection tab 110, or the aperture 116 can be expanded by removing additional material from the plate body 170. In accordance with one embodiment, the plate body 170 can define a projection 119 that at least partially defines the aperture 116 and can be equal in size and shape to the opening 117 that extends through the tab body 112. Thus, if it is desired to attach the exposed portion 209 of the drain wire 207 directly to the plate body 170, the exposed portion 209 can be attached (for instance, soldered, welded, or the like) to the projection 119. If it is desired to attach the drain wire 207 directly to the plate body 170, the drain wire connection tab can be removed.

Figure 5B:
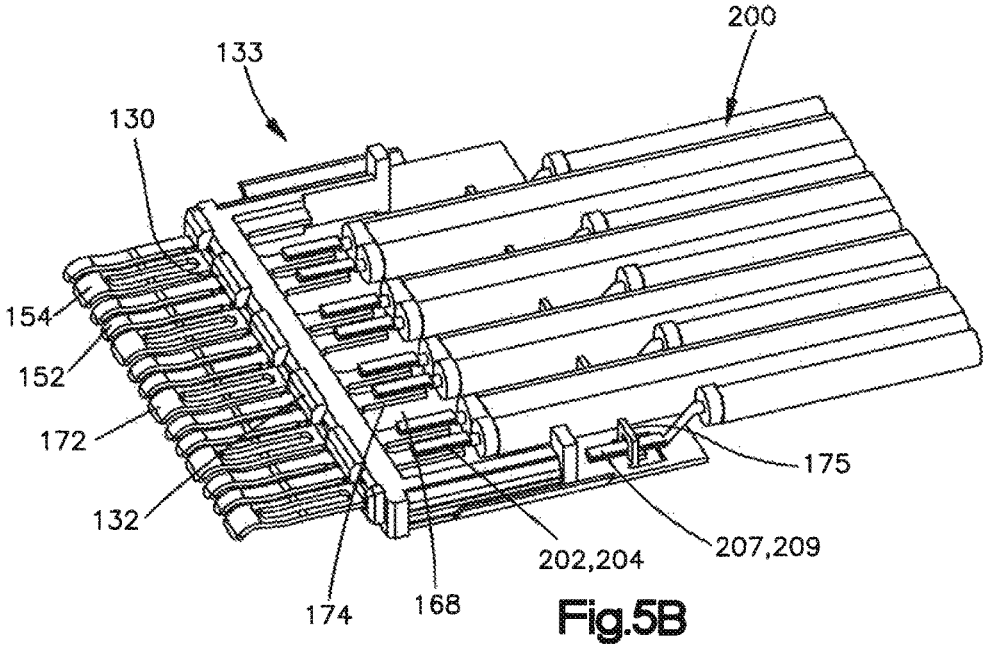
FIG. 5B is a perspective view of a leadframe assembly constructed in accordance with an alternative embodiment.

Referring now to FIG. 5B, and as described above, the ground contacts 154 can be discrete ground contacts that are separate from each other, and include a ground contact body that defines their own ground mating end 172 and ground mounting end 174. Thus, the ground contacts 154 can be non-monolithic with respect to each other, and the ground mounting ends 174 can be spaced from each other along the transverse direction T. The ground contacts 154 and the signal contacts 152 can be supported by the leadframe housing 132. The ground contacts 154 and the signal contacts 152 can, for instance, be overmolded by the leadframe housing 132. Thus, the leadframe assembly 130 can include the leadframe housing 132, and the signal contacts 152 and ground contacts 154 that are all supported by the leadframe housing 132. The signal contacts 152 and ground contacts 154 can be overmolded by the leadframe housing 132 such that the leadframe is an insert molded leadframe, and the leadframe assembly 130 is an insert molded leadframe assembly. The exposed portions 209 of the drain wires 207 can be attached, for instance soldered, welded, or otherwise attached, to the mounting ends 174. The ground plate 168 can be supported adjacent the leadframe assembly 130, and in particular adjacent the leadframe housing 132. For instance, the ground plate 168 can be attached to the leadframe housing 132. When the ground plate 168 is supported adjacent, or attached to, the leadframe housing 132, the ground contacts 154 are placed in electrical contact with the ground plate 168, while the signal contacts 152 are spaced from the ground plate 168. For instance, each of the ground contacts 154 can include contact tabs 175 that project out from the ground contact body toward the ground plate 168 so as to make contact with the ground plate 168 when the ground plate 168 is supported adjacent the leadframe housing 132. Thus, the contact tabs 175 make contact with the ground plate 168 when the ground plate 168 is attached to the leadframe housing 132. Because the contact tabs 175 contact the ground plate 168, the ground contacts 154 are placed in electrical contact with the ground plate 168 and each other.

The contact tabs 175 can be cut, for instance punched or stamped, from the ground contact body, for instance at a location proximate to the mounting end 174. Thus, the ground contacts 154 can define an opening that extends through the ground contact body that defines a location of the ground contact body from which the contact tabs 175 were cut. The exposed portions 209 of the drain wires 207 can be attached to the mounting ends at a location that is spaced from the openings in a direction opposite the mating direction. As illustrated in FIGS. 3 and 4D, the termination housing 190 is configured to secure to the leadframe housing 132 so as to capture the exposed portions of the outer insulative layer of the electrical cables 200, and in particular the conductors 202 and the drain wires 207, between the ground plate 168 and the termination housing 190. The termination housing 190 can further be configured to isolate each of the electrical cables 200 from the others of the electrical cables 200. The termination housing 190 can be electrically conductive, and includes an electrically conductive body 192 that can be configured to attach to the ground plate 168. In accordance with one embodiment, the electrically conductive body 192 is metallic. The electrically conductive body 192 can alternatively be made from a conductive lossy material. Alternatively, the body 192 of the termination housing can be made from a nonconductive material, such as a nonconductive plastic. The termination housing 190 can cover at least a portion of a first side of the leadframe assembly 130, such that the signal contacts 152 and ground contacts are disposed between the ground plate 168 and the termination housing 190. The termination housing 190 can further include a second portion that covers at least a portion of a second side of the leadframe assembly 130, and in particular the ground plate 168, that is opposite the first side, in the manner described above with respect to FIGS. 3 and 4D.

Figure 6A:
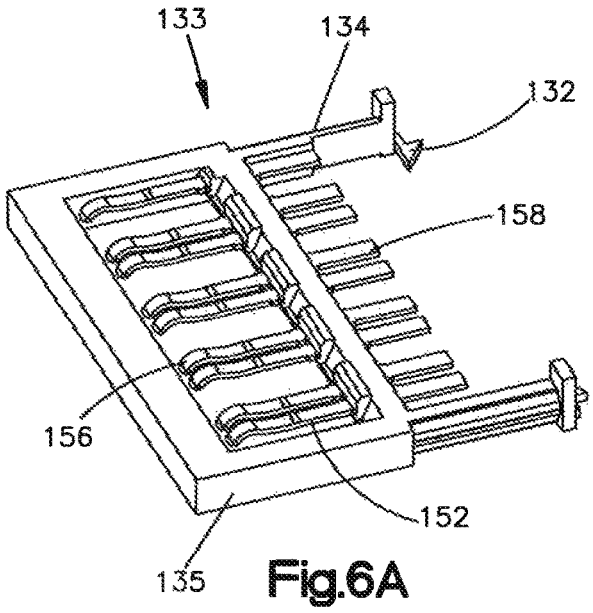
FIG. 6A is a perspective view of a portion of a leadframe assembly constructed in accordance with an alternative embodiment, including a leadframe housing and a plurality of electrical signal contacts supported by the leadframe housing.
Figure 6B:
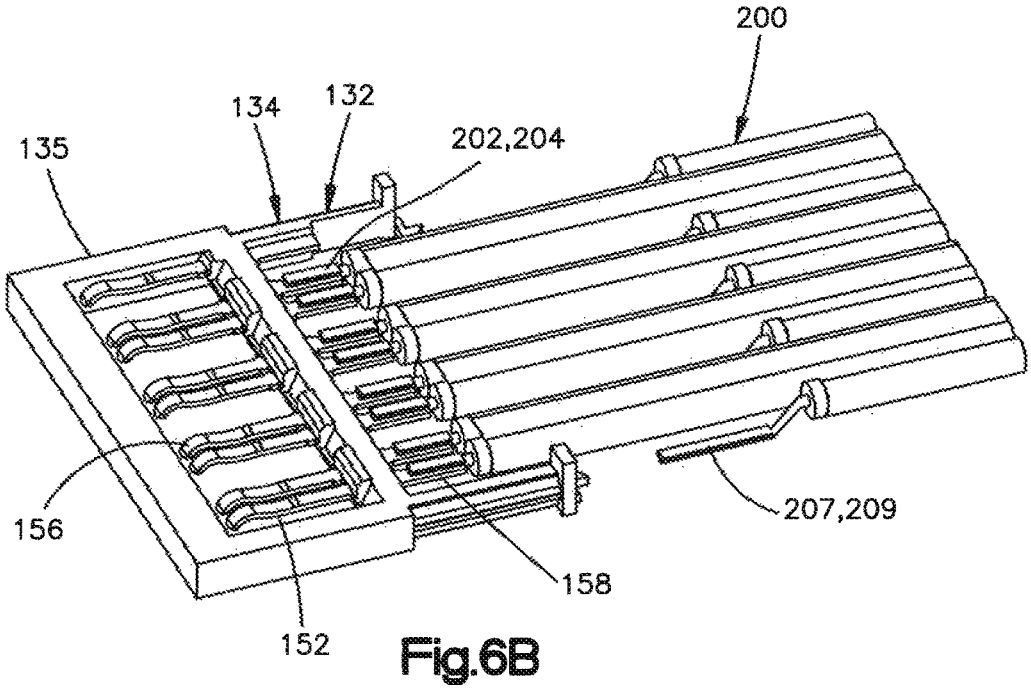
FIG. 6B is a perspective view of a portion of the leadframe assembly illustrated in FIG. 6A, but including a plurality of electrical cables having electrical signal conductors mounted to respective ones of the electrical signal contacts.
Figure 6C:
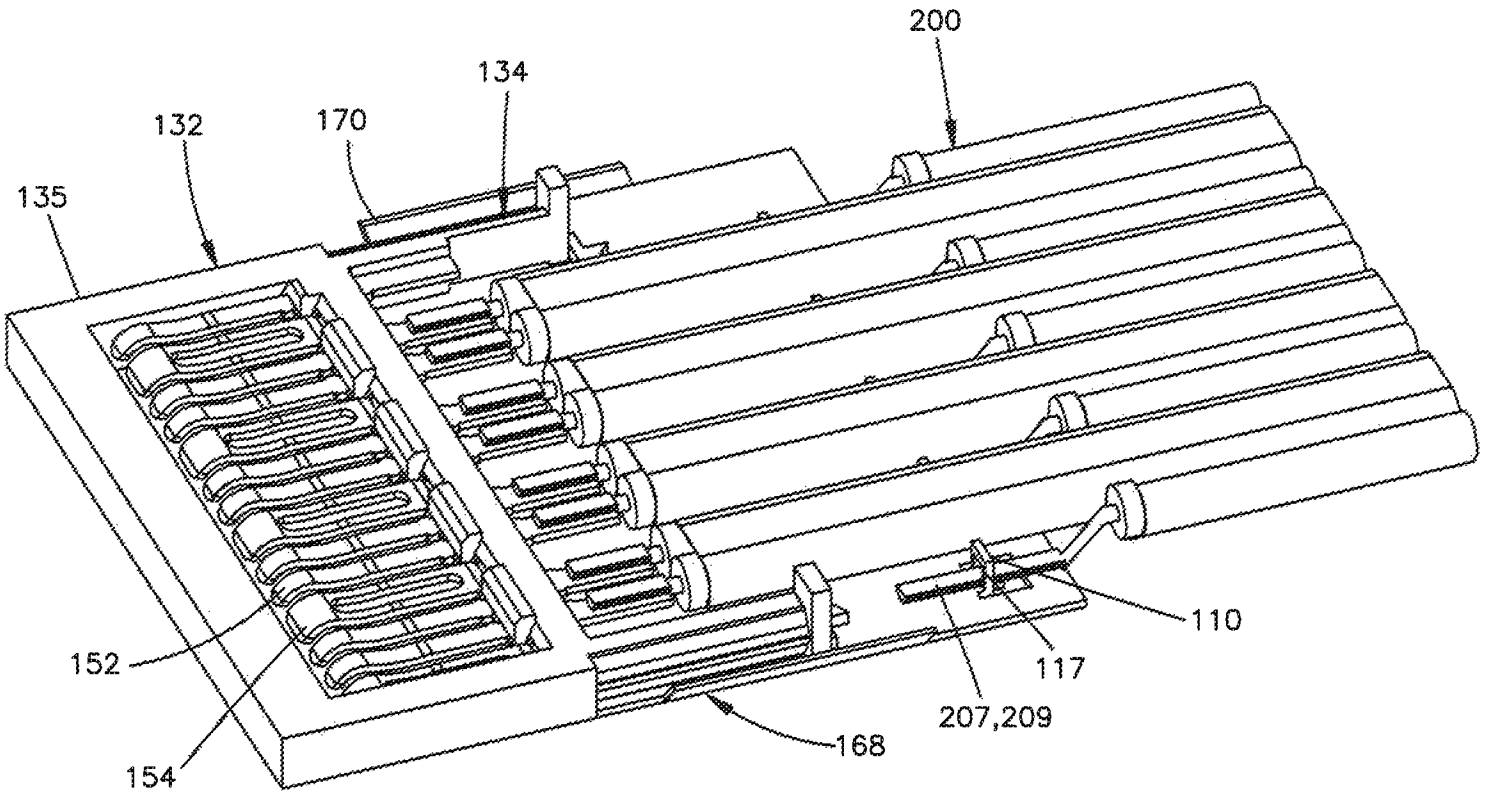
FIG. 6C is a perspective view of a portion of the leadframe assembly illustrated in FIG. 6B, but including a ground plate constructed in accordance with one embodiment.
Figure 6D:
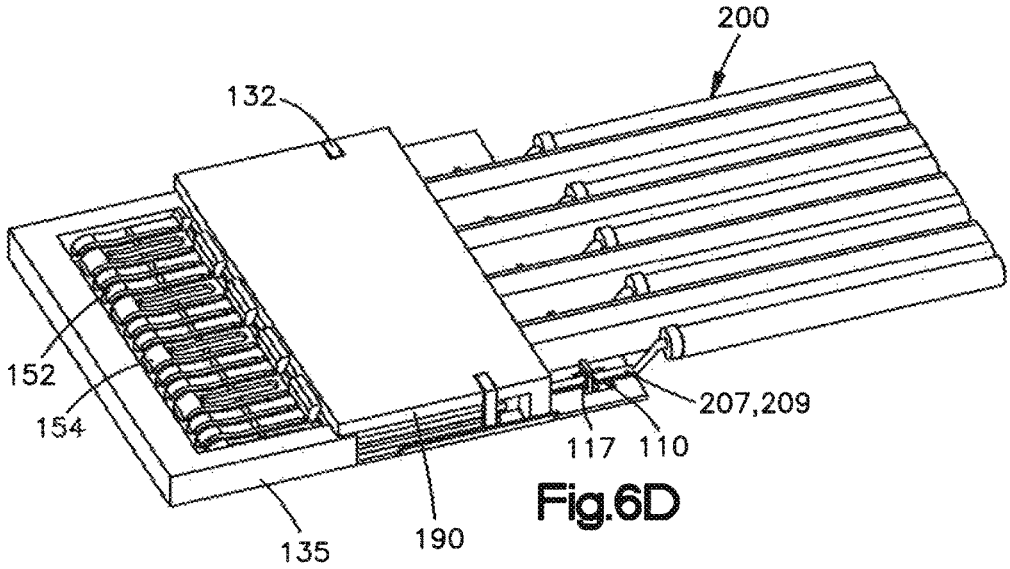
FIG. 6D is a perspective view of a portion of the leadframe assembly illustrated in FIG. 6C, but including a termination housing.
Figure 6E:
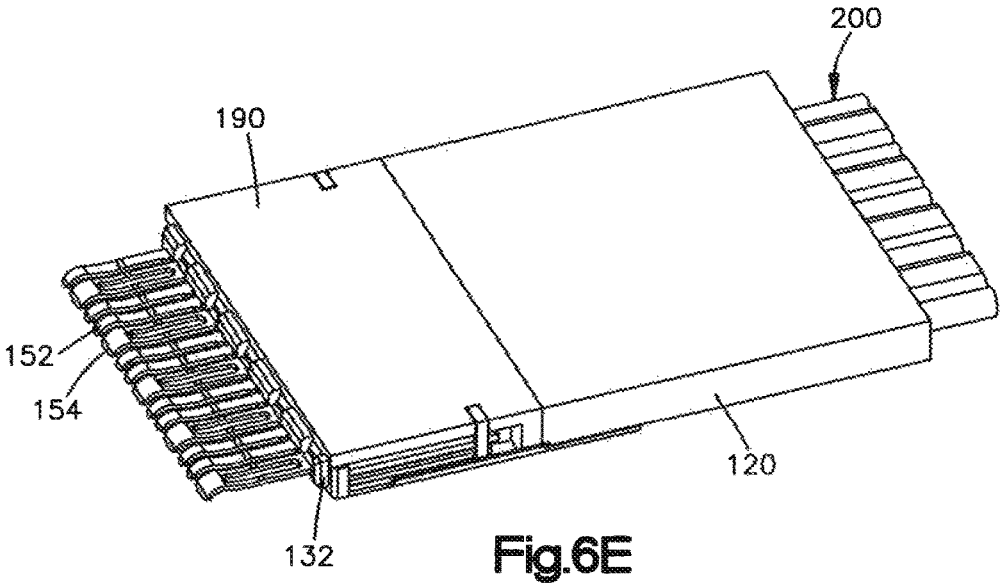
FIG. 6E is a perspective view of the leadframe assembly illustrated in FIG. 6D, but including a termination housing.
Figure 7C:
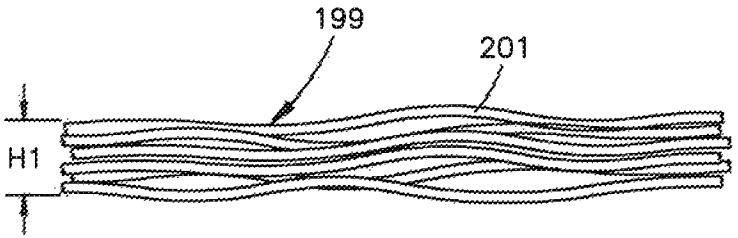
Fig.7C PRIOR ART
FIG. 7C is another perspective view of a conventional cable bundle.
Figure 7B:
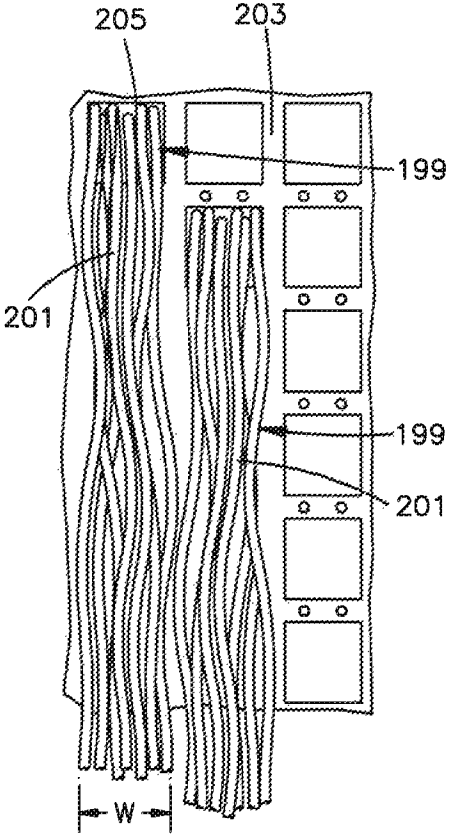
Fig.7B PRIOR ART
FIG. 7B is another perspective view of a conventional cable bundle.
Figure 7A:
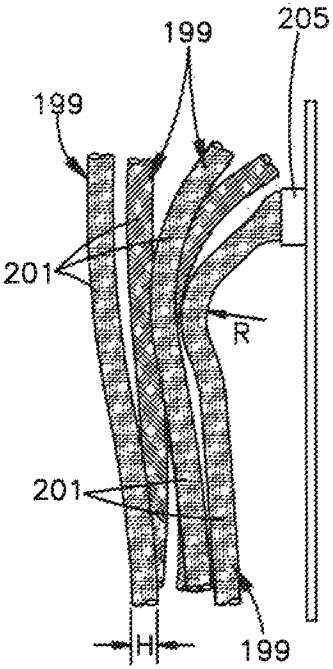
Fig.7A PRIOR ART
FIG. 7A is a perspective view of a conventional cable bundle.

Referring now to FIGS. 6A-6E, the leadframe assembly 130 can be constructed substantially as described above with respect to FIGS. 4A-E. The leadframe housing 132 can include a protective shroud 135 that surrounds the signal contacts 152 when the signal contacts 152 are supported by the leadframe housing 132, and further surrounds the ground mating end 172 when the ground plate 168 is supported by the leadframe 133. The shroud 135 can be removed from the housing body 134 prior to placing the electrical connector 100 in use. Further, as illustrated in FIGS. 6C-6E, the exposed portions 209 of the drain wires 207 can extend through respective ones of the openings 117 so as to make contact with the respective drain wire connection tabs 110, and thus be placed in electrical communication with the ground plate 168 and each other. In accordance with the illustrated embodiment, the drain wire connection tab can be devoid of the crossbar 115 of FIG. 5A, so that the drain wires 207 can be inserted into the respective openings 117 between the uprights 113 along a direction toward the ground plate so as to contact the uprights 113. For instance, the uprights 113 can be spaced from each other a distance substantially equal to or slightly less than a cross-sectional dimension of the respective drain wire 207. Thus, the strain relief housing 120 can be overmolded onto both the drain wire connection tabs 110 and the exposed portions 209 of the drain wires 207, thereby securing the drain wires 207 in contact with the respective drain wire connection tabs 110 without first crimping the drain wire connection tabs 110 about the drain wires 207, or first bending the drain wire connection tabs 110 so as to capture the drain wires 207 between the drain wire connection tabs 110 and the plate body 170. In accordance with another embodiment, each of the drain wire connection tabs 110 can further include an anti-backout tab that projects into the opening 117 and is angled forward along the mating direction as it extends into the opening. Thus, the anti-backout tab can be angled so as to allow the exposed portion 209 of the drain wire 207 to be inserted through the opening 117 along the mating direction, and prevent the drain wire 207 from being removed from the opening 117 in a direction opposite the mating direction. In particular, the anti-backout tab can bite into the drain wire 207 when a tensile force is applied to the drain wire 207 in the direction that is opposite the mating direction.

As illustrated in FIG. 1, the electrical connector system 20 is illustrated in accordance with one embodiment whereby the first and second electrical connectors 100 and 300 are configured to mate with each other in a shroud that extends through a panel. The second electrical connector 300 can be configured as a right angle connector so as to place the respective substrate in electrical connection with the cables 200. The first electrical connector 100 can include one or more guidance member, including an asymmetric guidance member that projects from the connector housing 106 along the mating direction. The guidance member can be rotated along an axis that extends along the longitudinal direction so as to position the asymmetric guidance member in one of a number of orientations in order to mate the first electrical connector with the second electrical connector 300.

The second electrical connector 300 can include a first dielectric or electrically insulative connector housing 302 and at least one electrical contact 304 such as a plurality of first electrical contacts 304 that are supported by the connector housing 302. In accordance with one embodiment, the second electrical connector 300 can include a plurality of leadframe assemblies that are supported by the connector housing 302. Each of the leadframe assemblies can include a dielectric or electrically insulative leadframe housing and respective ones of the plurality of the electrical contacts 304 supported by the leadframe housing. Thus, it can be said that the electrical contacts 304 are supported by both the respective leadframe housing and the connector housing 302. For instance, the leadframe housing can be overmolded onto the respective ones of the electrical contacts 304 so as to define an insert molded leadframe assembly (IMLA), or the electrical contacts 304 can be stitched into the leadframe housing or otherwise supported by the leadframe housing. The respective ones of the plurality of electrical contacts 304 of each of the leadframe assemblies can be arranged along a column direction, which extends along a transverse direction T that is perpendicular to the longitudinal direction L. Adjacent ones of the leadframe assemblies can be spaced along a row direction that is perpendicular to the column direction. For instance, the row direction can extend along a lateral direction A that is perpendicular to both the longitudinal direction L and the transverse direction T.

In accordance with the illustrated embodiment, the second electrical connector 300 is constructed as a vertical electrical connector. In particular, the connector housing 302 defines a mating interface 306 that is configured to engage a complementary mating interface of the first electrical connector 100 when the first and second electrical connectors 100 and 300 mate with each other. The connector housing 302 further defines a mounting interface that is configured to engage the substrate 400 when the second electrical connector 300 is mounted to the substrate 400. Further, the electrical contacts 304 define respective mating ends that are configured to mate with complementary mating ends of electrical contacts of the first electrical connector 100, and respective mounting ends that are configured to be mounted to the substrate 400. The mating ends of the electrical contacts 304 are oriented parallel to the mounting ends, such that the electrical contacts 304 can be referred to as vertical electrical contacts. Alternatively, the second electrical connector 300 can be configured as a right-angle electrical connector whereby the mating interface 306 and the mounting interface of the connector housing 302 are oriented perpendicular with respect to each other, and the mating ends and the mounting ends of the electrical contacts 304 are oriented perpendicular to each other. It should be further appreciated that the mating ends of the electrical contacts 304 can be configured as receptacle contacts.

The second electrical connector 300 can constructed in accordance with any suitable embodiment as desired. For instance, the second electrical connector can be constructed as described in U.S. patent application Ser. No. 13/836,610 filed Mar. 15, 2013, the disclosure of which is hereby incorporated by reference as if set forth in its entirety herein. For instance, the electrical contacts 304 can include a plurality of signal contacts and ground contacts arranged in any manner as desired. For instance, adjacent signal contacts can define differential signal pairs or single ended signal contacts as desired. For instance, each of the ground contacts of the second electrical connector 300 can define respective ground mating ends and ground mounting ends in electrical communication with the ground mating ends. Furthermore, each of the signal contacts of the second electrical connector 300 can define respective mating ends and mounting ends in electrical communication with the mating ends. Thus, it can be said that the mating ends of the electrical contacts 150 can define mating ends, which can include the mating ends of the electrical signal contacts and the ground mating ends, and the electrical contacts 1350 can further define mounting ends, which can include the mounting ends of the electrical signal contacts and the ground mounting ends. Because the mating ends of the signal contacts and the ground mating ends of the ground plate are provided as receptacle mating ends and receptacle ground mating ends, respectively, the second electrical connector 300 can be referred to as a receptacle connector. Each ground contact, including the ground mating ends and the ground mounting ends, can be defined by a ground plate of the respective leadframe assembly. The ground plate can be electrically conductive as desired. Alternatively, the ground mating ends and ground mounting ends can be defined by individual ground contacts as desired, and the ground plate can be devoid of ground mating ends and ground mounting ends. Thus, reference herein to one or more components of a ground contact can refer to components of one of the ground plates, or can refer to components of individual ground contacts. Furthermore, reference to a ground contact can refer to a ground plate or an individual ground contact having a single ground mating end and a single ground mounting end.

One or more ground contacts can be disposed between adjacent pairs of differential signal pairs. For instance, when the electrical contacts 304 are supported by respective leadframe housings, adjacent signal contacts, for instance along the column direction, can define differential signal pairs. The leadframe assemblies can include ground contacts disposed between adjacent pairs of differential signal pairs along the column direction. When the second electrical connector 300 is mounted to the substrate 400 along a mounting direction, the electrical contacts 304 are placed in electrical communication with electrical traces of the first substrate 400.

Referring now to FIGS. 7A-7C and 8F, the present disclosure recognizes that conventional cable bundles 199 include a plurality of electrical cables bundled in an outer sheath 201 that contains a respective one of the bundles 119 of electrical cables. The cables of the cable bundle 199 are configured to be attached to an electrical connector 205 in any manner as desired. The electrical connector 205 can be mounted onto a panel 203, such that the cable bundle 199 extends out from the panel 203. Cable bundles 199 typically have a height H and a width W that is perpendicular to the height and substantially equal to the height. For instance, when the electrical connector 205 is attached to the cable bundle 199 and mounted to the panel 203, it is often desired to bend the cable bundles 199 so as to route them to a desired location. However, it has been found that the height H causes the cable bundles 199 to define a large bend radius R, which causes the cable bundles 199 to extend out from the panel 203 a distance that can either occupy valuable real estate in the cabinet, or can be greater than the permissible distance inside the cabinet, particularly when the cable bundles 199 are stacked on top of each other. As illustrated, the width W extends along a direction that is parallel to the face of the panel 203, and the height is perpendicular to the width W. At certain locations along the length of the cable bundle 199, the height can extend along a direction that intersects the panel 203, for instance substantially perpendicular to the face of the panel 203.

As illustrated in FIGS. 8A-E and 8G, a cable assembly 500 constructed in accordance with one embodiment can include a cable bundle 502 that includes a plurality of electrical cables 200 (see FIG. 1) and an outer sheath 506 that surrounds the electrical cables 200. The electrical cables 200 can be attached to an electrical connector in any manner as desired, for instance as described above with respect to the first electrical connector 100. The conventional cable bundle 199 (see FIG. 7C) can define a height H1 that has been measured to be 23 mm. The cable assembly 500 can include a cable clip 508 that includes a clip body 510 and an opening 512 that extends through the clip body 510. The opening 512 can have any size and shape as desired, and in accordance with the illustrated embodiment defines a height H2 that is less than the height H1 of the conventional cable bundle 199. For instance, the height H2 can be approximately 10 mm, though it should be appreciated that the height H2 can be any distance as desired, depending for instance on the number of electrical cables of the cable bundle 502. It is recognized that by decreasing the height of the cable bundle 502 with respect to the prior art, the bend radius of the cable bundle 502 is reduced with respect to the bend radius of the conventional cable bundle 199, and that the bending force that causes the cable bundle 502 to bend along the bend radius is also reduced. Accordingly, a plurality of cable bundles 502 can be stacked on top of each other within the space permitted by the cabinet. For instance, the cable clips 508 of adjacent cable assemblies 500 can be stacked onto each other.

The cable bundles 502 can define a height H3 at locations spaced from the cable clip 508. The height H3 is greater than the height H2 in the opening 512 of the cable clip 508, and can be substantially equal to the height H1 of the conventional cable bundle 199. However, because the cable clip 508 can be located at the bend radius, the reduced height H2 provides for a reduced bend radius with respect to the prior art, and reduced bending force. It should be appreciated that because the height H2 increases gradually to the increased height H3 at locations increasingly away from the cable clip 508, the bend radius can intersect the cable clip 508, or the cable clip 508 can be disposed adjacent, and thus spaced from, the bend radius. Thus, the height of the opening can be defined along the bend radius, or can be coplanar with the bend radius.

Figure 8A:
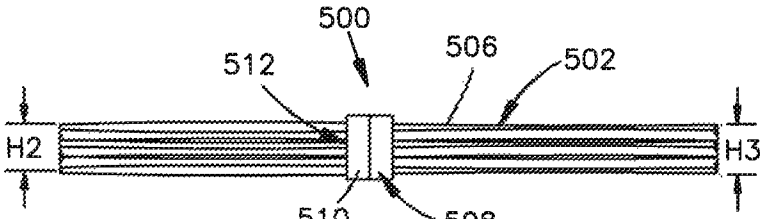
FIG. 8A is a perspective view of a cable bundle attached to a cable clip constructed in accordance with one embodiment.
Figure 8B:
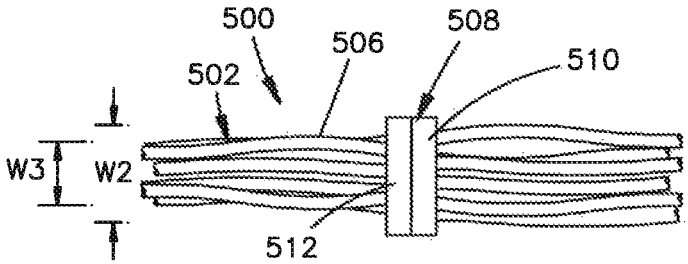
FIG. 8B is a top plan view of a cable bundle attached to the cable clip illustrated in FIG. 8A.
Figure 8C:
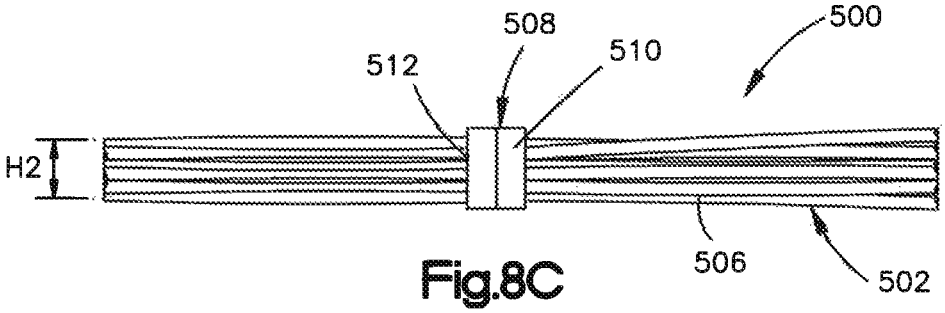
FIG. 8C is a side elevation view of the cable bundle attached to the cable clip as illustrated in FIG. 8B
Figure 8D:
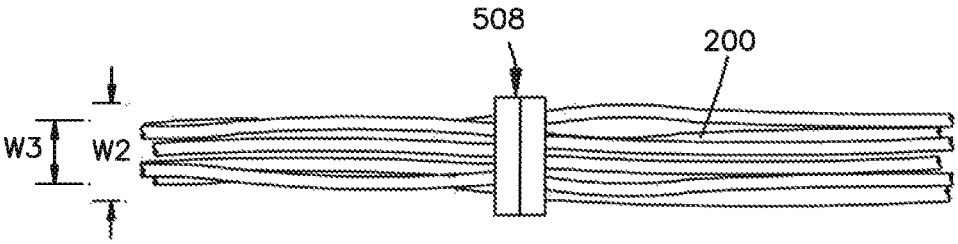
FIG. 8D is a top plan view of a plurality of wires of the cable bundle illustrated in FIG. 8B, shown with the outer sheath removed.
Figure 8E:
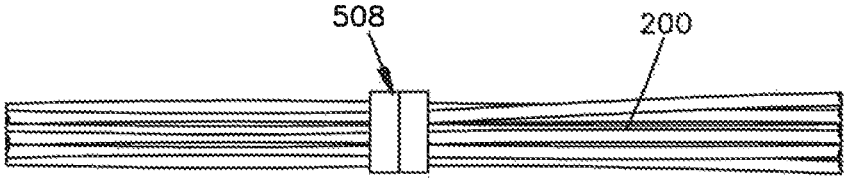
FIG. 8E is a side elevation view of the plurality of wires of the cable bundle illustrated in FIG. 8B, shown with the outer sheath removed
Figure 8F:
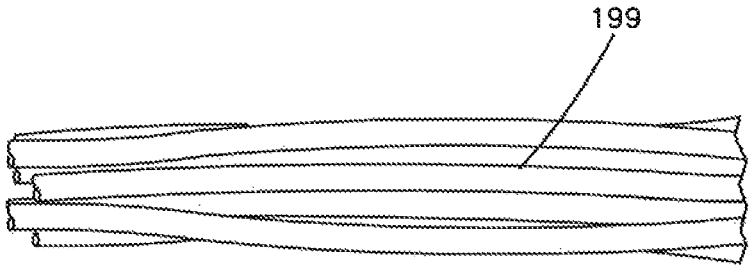
Fig.8F PRIOR ART
FIG. 8F is a top plan view of a conventional cable bundle, shown with the outer sheath removed.
Figure 8G:
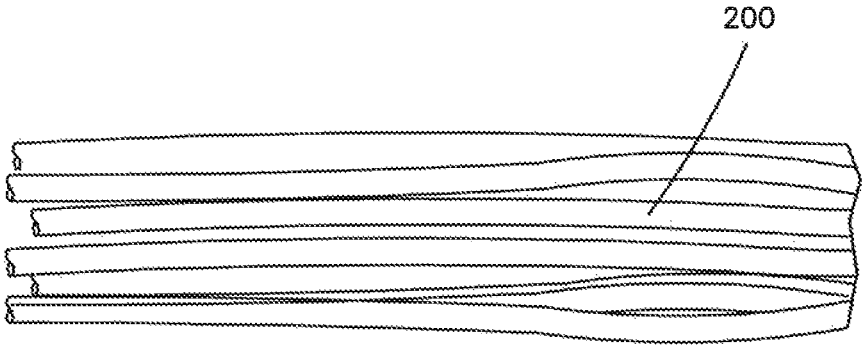
FIG. 8G is a top plan view of a cable bundle arranged as when attached to the cable clip constructed in accordance with one embodiment, shown with the outer sheath removed.
Figure 9B:
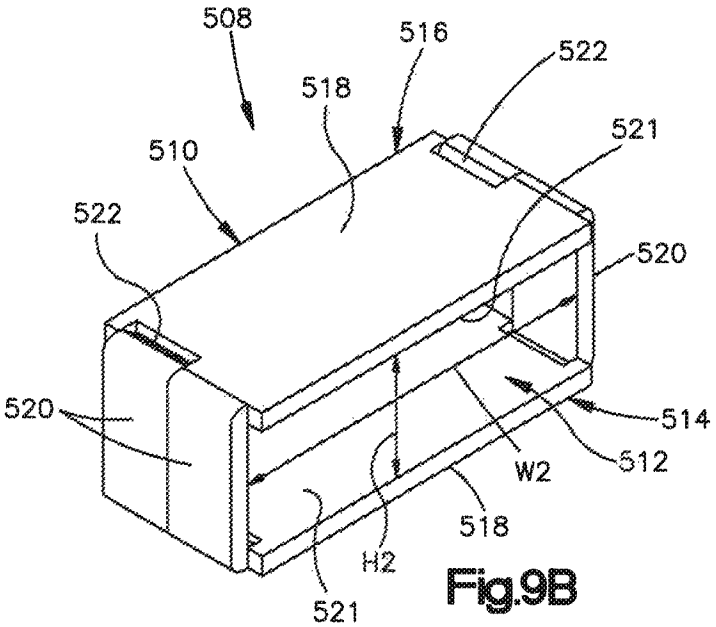
FIG. 9B is a perspective view of the cable clip illustrated in FIG. 9A.
Figure 9A:
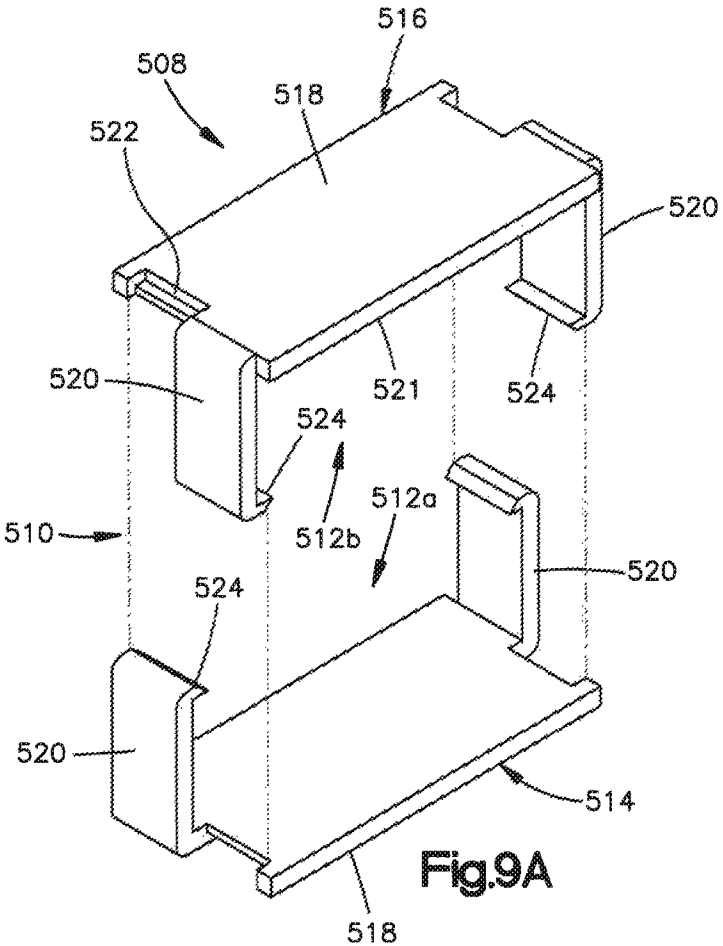
FIG. 9A is an exploded perspective view of the cable clip illustrated in FIG. 8A.
Figure 10B:
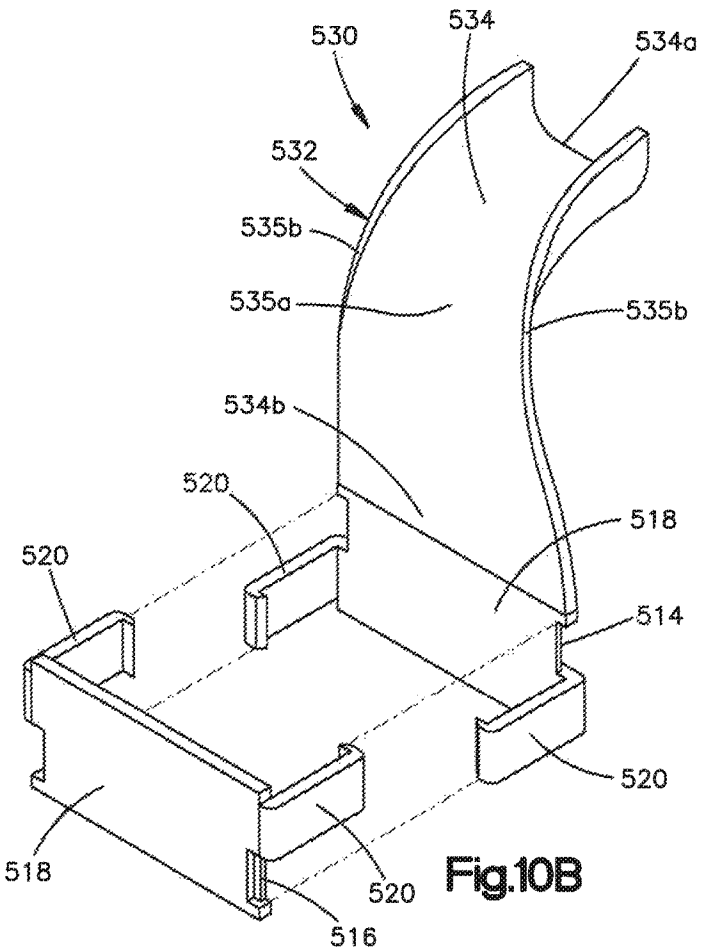
FIG. 10B is a perspective view of the cable guide illustrated in FIG. 10A, but showing the cable clip exploded.
Figure 10A:
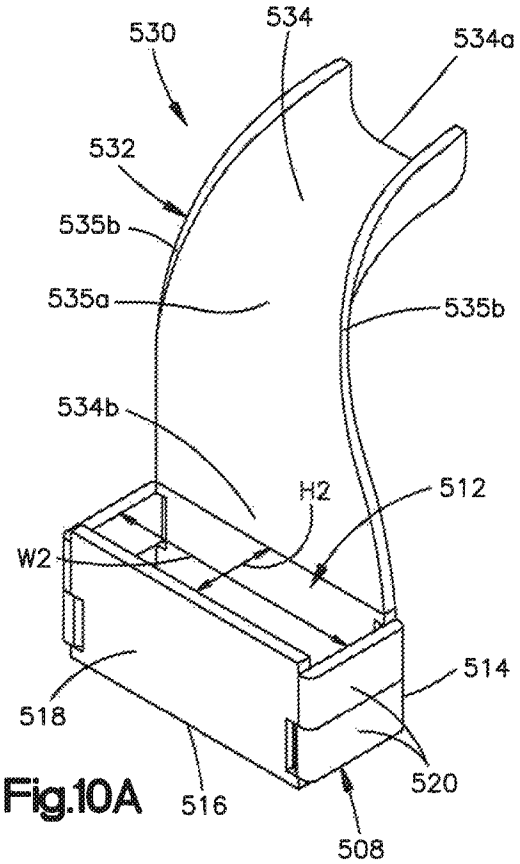
FIG. 10A is a perspective view of a cable guide that includes a guide body and the cable clip supported by the guide body.
Figure 10D:
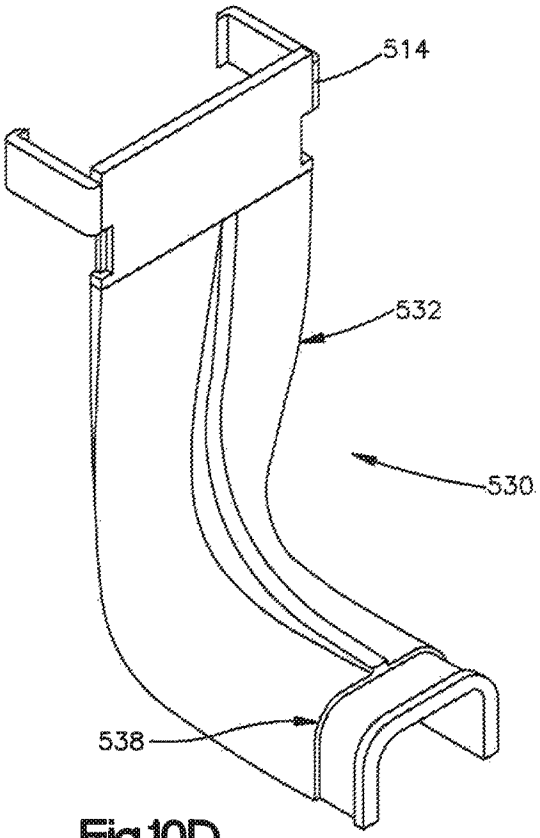
FIG. 10D is a perspective view of the cable guide as illustrated in FIG. 10A, but including a slot for a band attachment.
Figure 10C:
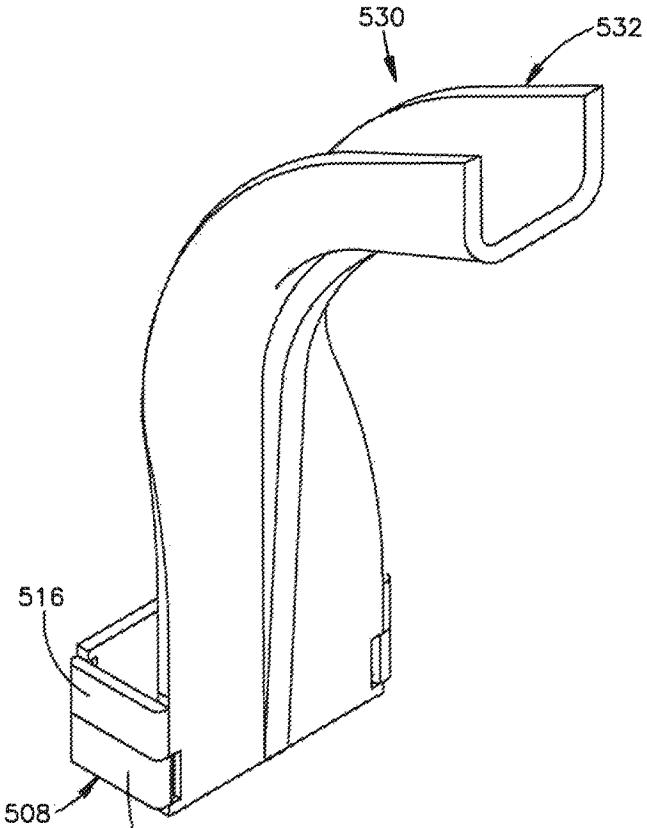
FIG. 10C is another perspective view of the cable guide illustrated in FIG. 10A.
Figure 10E:
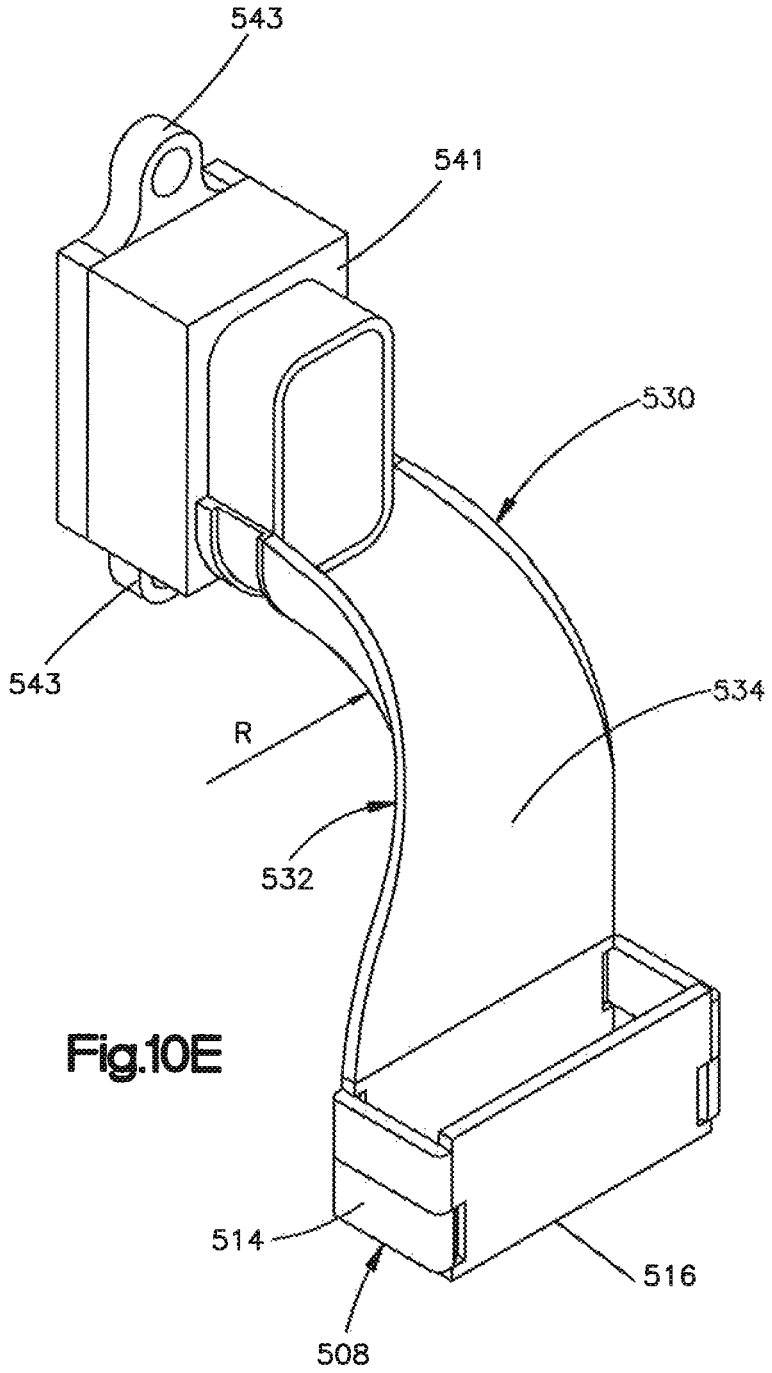
FIG. 10E is a perspective view of the cable guide illustrated in FIG. 10D, but showing the band attached.

It is recognized that the cable clip 508 applies a compressive force to the cable bundle 502 that decreases the height, and accordingly causes the cables 200 of the cable bundle 502 to fan or spread out along the width, thereby increasing the width W2 to a width greater than the width W1 of the conventional cable bundle 199, shown in FIG. 8F. However, the increased width W2 is measured along a direction that is substantially perpendicular to the bend radius. The cable bundles 502 can define a width W3 at locations spaced from the cable clip 508. The width W3 is less than the width W2 at the opening 512 cable clip 508, and can be substantially equal to the width W1 of the conventional cable bundle 199. FIGS. 8D and 8G illustrate the dimensions of the cables 200 with the outer sheath 506 removed to illustrate the compression of the cables 200 along the height and expansion of the cables 200 along the width when the cable clip 508 is attached. It should be appreciated that because the cable clip 508 surrounds the outer sheath 506 of the cable bundle 502, the cable clip 508 further surrounds the individual cables 200 as well. Alternatively, the cable bundle 502 can be devoid of the outer sheath 506, and the cable clip 508 can surround the individual cables 200 directly.

Thus, a method can be provided for managing a plurality of electrical cables 200. The method can include the steps of attaching the plurality of electrical cables 200 to the electrical connector 100 (see FIG. 1), such that the electrical cables 200 extend out from the electrical connector 100. The method can further include the step of securing the cable clip 508 onto the plurality of electrical cables 200 such that the electrical cables 200 extend through the opening 512 of the cable clip 508. The opening has a height and a width that is perpendicular to the height and greater than the height. The method can further include the step of bending the electrical cables about a bend radius that is substantially coplanar with the height. For instance, the bend radius can be substantially parallel to the height, and can define the height in accordance with certain embodiments. Thus, the height can be measured along the bend radius. The securing step can include the step of causing the cables 200 to expand away from each other along the width and to compress against each other along the height. The securing step can be performed before or after the attaching step. As will be described below with respect to FIGS. 10A-10E, the bending step can further include directing the cables 200 along a cable guide 530 that defines the bend radius. The cable guide 530 can define a guide body 532 and the cable clip 508 that is supported by the guide body 532.

The method can further include the step of 1) attaching a second plurality of electrical cables to a second electrical connector, such that the second plurality of electrical cables extend out from the second electrical connector, 2) securing a second cable clip onto the second plurality of electrical cables such that the second plurality of electrical cables extend through a second opening of the second cable clip, the second opening having a height and a width that is perpendicular to the height and greater than the height, 3) bending the second plurality of electrical cables about a second bend radius that is substantially coplanar with the height of the second opening, and 4) stacking the cable clips onto each other along a direction that defines the respective heights.

Referring now to FIGS. 8A-9B, the cable clip 508 includes the clip body 510 and the opening 512 that extends through the clip body 510. The opening 512 has a height that is less than the height of the plurality of electrical cables 200, for instance of the bundle 502 of electrical cables 200, and a width greater than the width of the plurality of electrical cables 200, for instance of the bundle 502 of electrical cables 200. The opening 512 can be sized such that when the plurality of electrical cables 200 extends through the opening 512, the height of the electrical cables 200 is decreased to the height of the opening 512, and the width of the plurality of electrical cables 200 is increased to the width of the opening 512. A cable assembly can include the cable clip 508 and the plurality of electrical cables 200. The width W2 of the opening 512 is greater than the height H2 of the opening, and can be less than any multiple of the height H2 of the opening 512, for instance less than five times the height H2 of the opening 512. In accordance with one embodiment, the width W2 can be greater than three times the height H2 of the opening 512 and less than four times the height H2 of the opening 512. For instance, the width can be approximately 37 mm and the height can be approximately 10 mm.

The cable clip can include 508 a first component 514 defining a first portion 512*a* of the opening 512, and a second component 516 that defines a second portion 512*b* of the opening 512. The first and second components 514 and 516 are configured to be attached to each other about the plurality of electrical cables 200, for instance the cable bundle 502, to define the opening 512 such that the plurality of electrical cables 200 extends through the opening 512. The first and second components 514 and 516 can be hermaphroditic with each other. For instance, each of the first and second components 514 and 516 includes a body 518, and a pair of legs 520 that extend out from the body 518. Each body 518 of the first and second components 514 and 516 can define a pair of recesses 522 that are sized to receive protrusions 524 of each of the pair of legs 520 of the other of the first and second components 514 and 516, thereby attaching the first and second components 514 and 516 to each other. It should be appreciated, of course, that the first and second components 514 and 516 can be attached to each other in accordance with any embodiment as desired. The first and second components 514 and 516, including the respective body 518 and legs 520, define respective inner surfaces 521 that, in combination, define the opening 512 of the cable clip 508 when the first and second components 514 and 516 are attached to each other.

Referring now also to FIGS. 10A-10E, the cable assembly can further include a cable guide 530 that includes a guide body 532 and the cable clip 508 that is supported by the guide body 532. For instance, at least one of the first and second components, such as the first component 514, can be monolithic with the guide body 532. The guide body 532 defines a guide surface 534 that can be curved. For instance, the guide surface 534 can be convex. The guide surface 534 can define a bend radius R. Alternatively, the guide surface 534 can define any sized and shaped curvature as desired. The opening 512 of the cable clip 508 can be operatively aligned with the guide surface 534 such that when the plurality of cables extends along the guide surface 534, the plurality of cables further extends through the opening 512. The guide surface 534 can include a base 535*a* and a pair of side walls 535*b* that extend out from the base, such that the supported plurality of cables 200 are disposed between the side walls. Accordingly, the base 535*a* and the side walls 535*b* can cooperate to define the guide surface 534. The bundle 502 of electrical cables 200 can be supported by the base 535*a* at a location between the side walls 535*b*, so as to extend through the opening 512. The cable guide 530 can further include a slot 538 that extends into an outer surface of the guide body 532 that is opposite the guide surface 534. The slot 538 can be defined by both the base 535*a* and each of the pair of side walls 535*b*. The slot 538 can extend into the outer surface toward the guide surface 534, but can terminate prior to reaching the guide surface 534. The cable assembly can further include a band 541 that is configured to extend about the cable guide 530 in the slot 538 further extend about and the plurality of cables 200 so as to secure the plurality of cables 200 to the cable guide 530. The band 541 can include any suitable mounting apparatus 543 that is configured to be mounted onto the panel. In accordance with the illustrated embodiment, the guide surface 534 defines a first end 534*a* and a second end 534*b* that is opposite the first end 534*a*. The guide surface 534 can be configured such that the first end 534*a* is oriented perpendicular to the second end 534*b*. The cable clip 508 can be supported by the guide body 532 at the second end 534*b* of the guide surface 534. The cable guide 530 is configured to be supported adjacent to the electrical connector 100 at a location proximate to the first end 534*a* of the guide surface 534

The foregoing description is provided for the purpose of explanation and is not to be construed as limiting the invention. While various embodiments have been described with reference to preferred embodiments or preferred methods, it is understood that the words which have been used herein are words of description and illustration, rather than words of limitation. Furthermore, although the embodiments have been described herein with reference to particular structure, methods, and embodiments, the invention is not intended to be limited to the particulars disclosed herein. For instance, it should be appreciated that structure and methods described in association with one embodiment are equally applicable to all other embodiments described herein unless otherwise indicated. Those skilled in the relevant art, having the benefit of the teachings of this specification, may effect numerous modifications to the invention as described herein, and changes may be made without departing from the spirit and scope of the invention, for instance as set forth by the appended claims.

What is claimed:

1. An electrical connector comprising:

an electrically insulative connector housing; and a leadframe supported by the connector housing, the leadframe including an electrically insulative leadframe housing and a plurality of electrical signal contacts supported by the leadframe housing, the electrical signal contacts comprising mounting ends; and an electrically conductive ground plate positioned adjacent to the leadframe housing, the ground plate including an electrically conductive plate body comprising a first edge, a second edge opposite the first edge, and a drain wire connection location, wherein the first edge of the plate body is adjacent to the mounting ends of the signal contacts and the second edge of the plate body is adjacent to the drain wire connection location;

wherein the electrical connector is configured to receive at least one electrical cable such that at least one signal conductor of the electrical cable is attached to a corresponding mounting end of at least one of the signal contacts adjacent the first edge of the plate body, and a drain wire of the electrical cable is attached to the drain wire connection location adjacent to the second edge of the plate body, thereby placing the drain wire in electrical communication with the ground plate.

2. A leadframe assembly comprising:

a leadframe, the leadframe including an electrically insulative leadframe housing and a plurality of electrical signal contacts supported by the leadframe housing;

an electrically conductive ground plate positioned adjacent to the leadframe housing, the ground plate including an electrically conductive plate body and a crimp member that projects out from the plate body;

wherein the leadframe assembly is configured to receive at least one electrical cable such that at least one signal conductor of the electrical cable is attached to a corresponding at least one of the plurality of electrical signal contacts, and a drain wire of the electrical cable is mechanically attached to the crimp member, thereby placing the drain wire in electrical communication with the electrically conductive ground plate;

wherein the crimp member defines a body having a proximal end that is attached to the ground plate and a free distal end opposite the proximal end, the free distal end spaced from the proximal end.

3. The electrical connector as recited in claim 1, wherein the ground plate further comprises a plurality of ground mating ends that extend from the plate body.

4. The electrical connector as recited in claim 3, wherein the plurality of ground mating ends are monolithic with the plate body.

5. The electrical connector as recited in claim 1, wherein the ground plate is supported by the leadframe housing.

6. An electrical connector comprising:

an electrically insulative connector housing; and a leadframe supported by the connector housing, the leadframe including an electrically insulative leadframe housing;

a plurality of electrical signal contacts supported by the leadframe housing;

a plurality of ground contacts supported by the leadframe housing; and an electrically conductive ground plate positioned adjacent to the leadframe housing such that the plurality of ground contacts are in electrical contact with the ground plate and the electrical signal contacts are spaced from the ground plate, wherein the electrical connector is configured to receive at least one electrical cable such that at least one signal conductor of the electrical cable is attached to a corresponding at least one of the plurality of signal contacts, and a drain wire of the electrical cable is attached to a corresponding one of the plurality of ground contacts, thereby placing the drain wire in electrical communication with the ground plate via the ground contact.

7. A leadframe assembly comprising:

a leadframe supported by a connector housing, the leadframe including an electrically insulative leadframe housing;

a plurality of electrical signal contacts supported by the leadframe housing;

an electrically conductive ground plate including a plurality of ground contacts, the ground plate positioned adjacent to the leadframe housing such that:

the plurality of ground contacts are aligned with the plurality of electrical signal contacts, and the plurality of electrical signal contacts are spaced from the ground plate, wherein the electrical connector is configured to receive at least one electrical cable such that at least one signal conductor of the electrical cable is attached to a corresponding at least one of the plurality of signal contacts, and a drain wire of the electrical cable is attached to a corresponding one of the plurality of ground contacts, thereby placing the drain wire in electrical communication with the ground plate.

8. The leadframe assembly of claim 7, wherein the crimp member is movable with respect to the plate body such that the free distal end moves toward the plate body, thereby capturing the drain wire in electrical communication with the ground plate.

9. The leadframe assembly of claim 2, configured to mate with a complementary electrical connector along a mating direction, wherein the crimp member is attached to the plate body at an interface that is elongate along the mating direction.

10. The leadframe assembly of claim 2, configured to mate with a complementary electrical connector along a mating direction, wherein the crimp member is attached to the plate body at an interface that is elongate along a direction that is angularly offset with respect to the mating direction.

11. The leadframe assembly of claim 2, wherein the crimp member is cut out from the plate body.

12. An electrical connector comprising:

an electrically insulative connector housing; and a leadframe supported by the connector housing, the leadframe including an electrically insulative leadframe housing and a plurality of electrical signal contacts supported by the leadframe housing; and an electrically conductive ground plate positioned adjacent to the leadframe housing, the ground plate including an electrically conductive plate body and a drain wire connection tab cut out from the ground plate, the drain wire connection tab including a tab body and an opening that extends through the tab body, wherein:

the electrical connector is configured to receive an electrical cable such that at least one signal conductor of the electrical cable is attached to a corresponding at least one of the signal contacts, and the opening is sized to receive a drain wire of the electrical cable such that the drain wire is mechanically attached to the drain wire connection tab, thereby placing the drain wire in electrical communication with the ground plate.

13. The electrical connector as recited in claim 12, configured to mate with a complementary electrical connector along a mating direction, wherein the opening extends through the tab body along the mating direction.

14. The electrical connector as recited in claim 12, wherein the opening is sized to maintain connection between the tab body and the drain wire, when the drain wire extends through the opening, without bending the tab body toward the plate body.

15. The electrical connector as recited in claim 12, wherein the drain wire connection tab comprises an anti-backout tab that projects into the opening so as to allow insertion of the drain wire through the opening in a mating direction, but prevents the drain wire from being removed from the opening in a direction opposite the mating direction.

16. The electrical connector as recited in claim 1, further comprising a strain relief housing that surrounds at least a connection location between the drain wire and drain wire connection location.

17. The electrical connector of claim 1, wherein the at least one electrical cable comprises a ground jacket, and the ground jacket is removed in a portion of the at least one electrical cable over the electrically conductive ground plate.

* * * * *